US009220342B2

(12) United States Patent
Byrne et al.

(10) Patent No.: US 9,220,342 B2
(45) Date of Patent: Dec. 29, 2015

(54) TABLE COUPLING SYSTEM WITH POWER AND DATA

(71) Applicants: Norman R. Byrne, Ada, MI (US); Daniel P. Byrne, Lowell, MI (US); Timothy J. Warwick, Sparta, MI (US); Brent A. Reame, Grand Rapids, MI (US); Chad Zimmerman, Hastings, MI (US); William F. Schacht, Grand Rapids, MI (US); Randell E. Pate, Jenison, MI (US); Robert L. Knapp, Rockford, MI (US)

(72) Inventors: Norman R. Byrne, Ada, MI (US); Daniel P. Byrne, Lowell, MI (US); Timothy J. Warwick, Sparta, MI (US); Brent A. Reame, Grand Rapids, MI (US); Chad Zimmerman, Hastings, MI (US); William F. Schacht, Grand Rapids, MI (US); Randell E. Pate, Jenison, MI (US); Robert L. Knapp, Rockford, MI (US)

( * ) Notice: Subject to any disclaimer, the term of this patent is extended or adjusted under 35 U.S.C. 154(b) by 161 days.

(21) Appl. No.: 14/049,376

(22) Filed: Oct. 9, 2013

(65) Prior Publication Data

US 2014/0106610 A1 Apr. 17, 2014

Related U.S. Application Data

(60) Provisional application No. 61/832,724, filed on Jun. 7, 2013, provisional application No. 61/713,481, filed on Oct. 12, 2012.

(51) Int. Cl.

| | |
|---|---|
| ***H01R 13/73*** | (2006.01) |
| ***H01R 25/14*** | (2006.01) |
| ***A47B 97/00*** | (2006.01) |
| ***A47B 87/00*** | (2006.01) |
| *A47B 21/06* | (2006.01) |

(52) U.S. Cl.

CPC ..... *A47B 97/00* (2013.01); *A47B 87/002* (2013.01); *A47B 2021/066* (2013.01)

(58) Field of Classification Search

CPC ..... H01R 13/73; H01R 25/14; H01R 25/162; H01R 25/006; H02G 5/08; A47F 5/005; A47F 57/58

See application file for complete search history.

(56) References Cited

U.S. PATENT DOCUMENTS

| | | | | |
|---|---|---|---|---|
| D202,779 | S | 11/1965 | Rosenbaum | |
| D275,921 | S | 10/1984 | Ward | |
| 4,488,653 | A | 12/1984 | Belokin | |
| D322,255 | S | 12/1991 | Prados | |
| 5,575,668 | A * | 11/1996 | Timmerman | A47B 21/06 174/482 |
| 6,004,157 | A * | 12/1999 | Glass | A47B 21/06 439/535 |
| 6,179,665 | B1 * | 1/2001 | Rossman et al. | 439/654 |
| 6,315,604 | B1 * | 11/2001 | Lee | H01R 13/516 439/535 |

(Continued)

*Primary Examiner* — Gary Paumen

(74) *Attorney, Agent, or Firm* — Gardner, Linn, Burkhart & Flory, LLP

(57) ABSTRACT

A work surface coupling system has power and data capability with an elongate housing defining an internal passageway and having first and second coupling regions for coupling to one or more work surface. The housing may be a one-piece unit or multi-piece assembly, and can support at least one power or data outlet positioned therealong. The internal passageway unobtrusively supports a plurality of electrical conductors associated with power or data outlets. Optional features include one or more removable side panels, laterally-extending support pads, an accessory mounting surface, and various work surface accessories such as shelving, privacy panels, and lighting.

20 Claims, 30 Drawing Sheets

(56) References Cited

U.S. PATENT DOCUMENTS

| | | | | |
|---|---|---|---|---|
| 6,379,182 | B1 * | 4/2002 | Byrne | H01R 13/74 439/574 |
| 6,515,224 | B1 * | 2/2003 | Pedro | 174/491 |
| D495,539 | S | 9/2004 | Sjoberg | |
| D513,970 | S | 1/2006 | Sterling et al. | |
| 7,004,786 | B1 * | 2/2006 | Bloom | H01R 13/72 439/142 |
| 7,083,421 | B1 * | 8/2006 | Mori | H01R 25/006 439/574 |
| D537,325 | S | 2/2007 | Wolff et al. | |
| 7,338,301 | B2 | 3/2008 | Grundon | |
| 7,407,392 | B2 * | 8/2008 | Cooke et al. | 439/131 |
| D592,945 | S | 5/2009 | Mahan | |
| 7,736,178 | B2 | 6/2010 | Byrne | |
| 7,938,679 | B2 * | 5/2011 | Wadsworth | H01R 13/74 439/574 |
| D651,433 | S | 1/2012 | Le et al. | |
| 8,134,254 | B2 * | 3/2012 | Makwinski | G06F 1/26 307/122 |
| D659,449 | S | 5/2012 | Lawson | |
| 8,172,604 | B2 | 5/2012 | Byrne | |
| 8,295,036 | B2 * | 10/2012 | Byrne | 361/679.01 |
| 8,444,425 | B2 | 5/2013 | Byrne | |
| 2002/0119698 | A1 * | 8/2002 | McCarthy | H01R 27/02 439/574 |
| 2004/0219828 | A1 * | 11/2004 | Pulyk | G06F 1/266 439/535 |
| 2008/0121147 | A1 * | 5/2008 | Cooke | A47B 21/06 108/50.02 |
| 2008/0200050 | A1 * | 8/2008 | Byrne | 439/131 |
| 2009/0029576 | A1 * | 1/2009 | Shunjie | 439/131 |
| 2009/0142947 | A1 * | 6/2009 | Byrne | 439/131 |
| 2009/0310291 | A1 * | 12/2009 | Willburn et al. | 361/679.22 |
| 2010/0195288 | A1 * | 8/2010 | Byrne | H01R 25/003 361/724 |
| 2011/0089768 | A1 | 4/2011 | Byrne et al. | |
| 2011/0177714 | A1 * | 7/2011 | Byrne | H02G 3/185 439/535 |

* cited by examiner

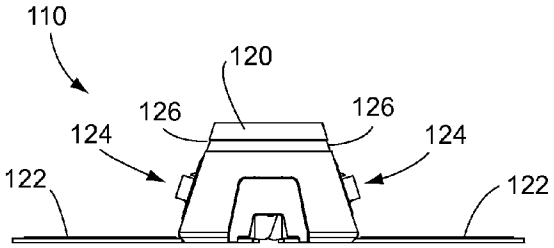
Fig. 14
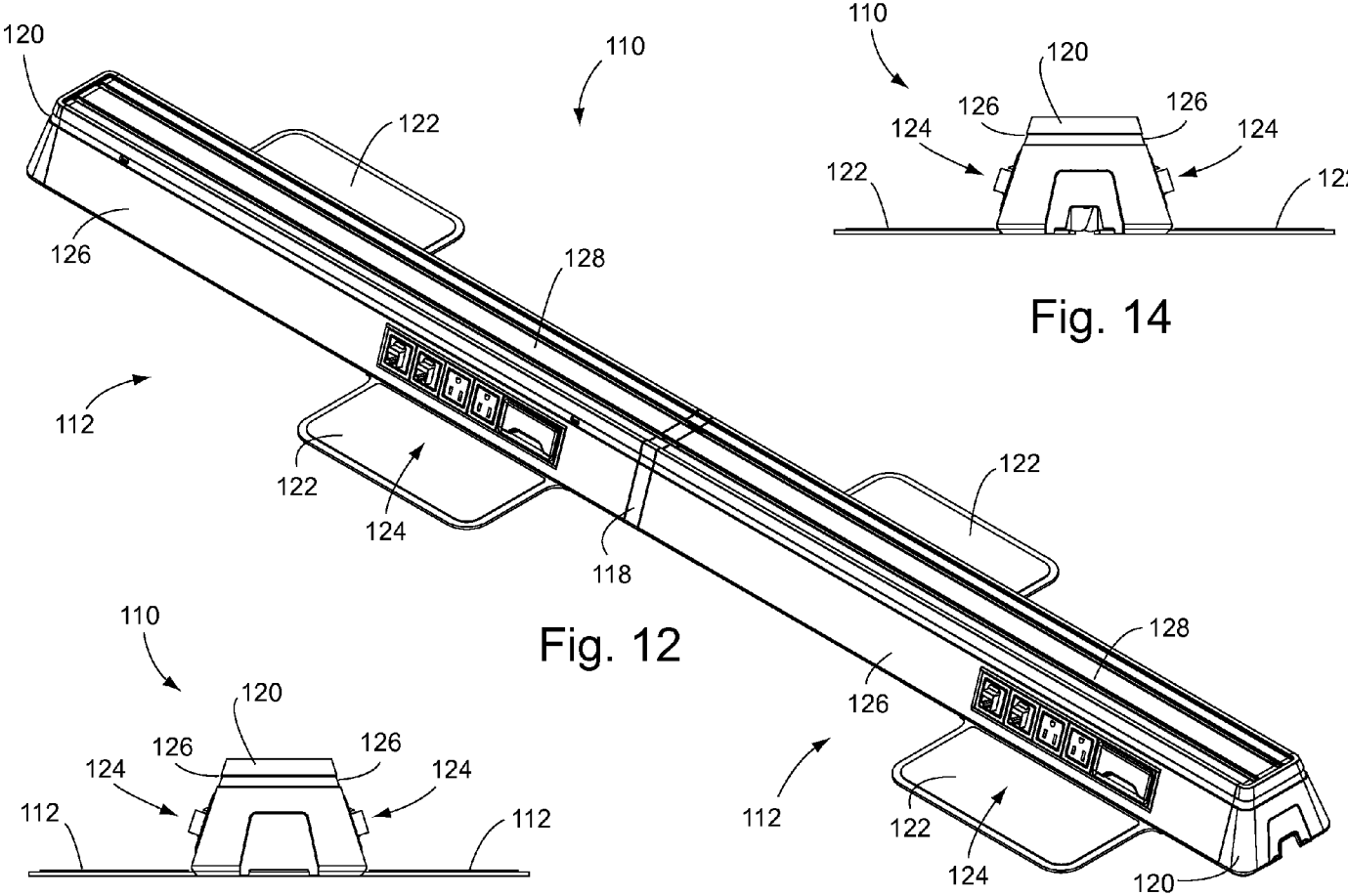
Fig. 12
Fig. 13

Fig. 35A
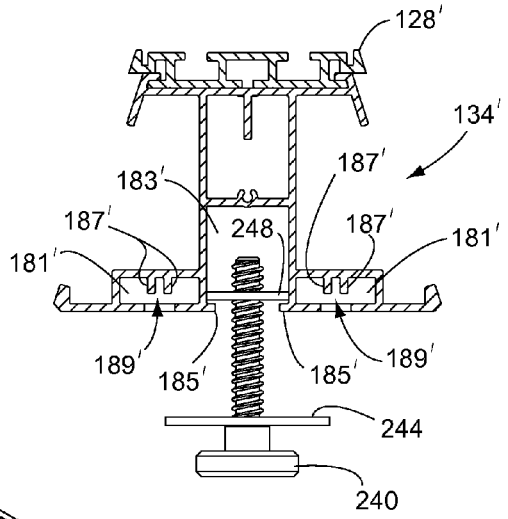
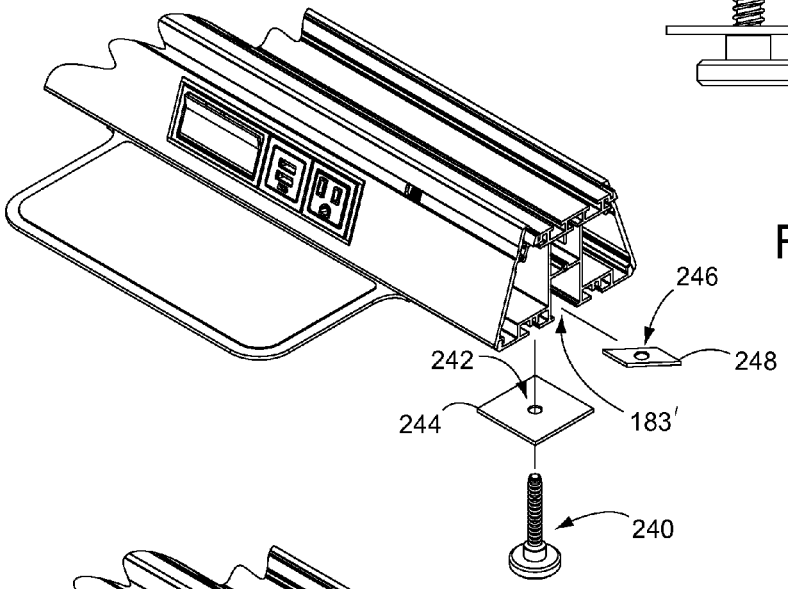
Fig. 35B
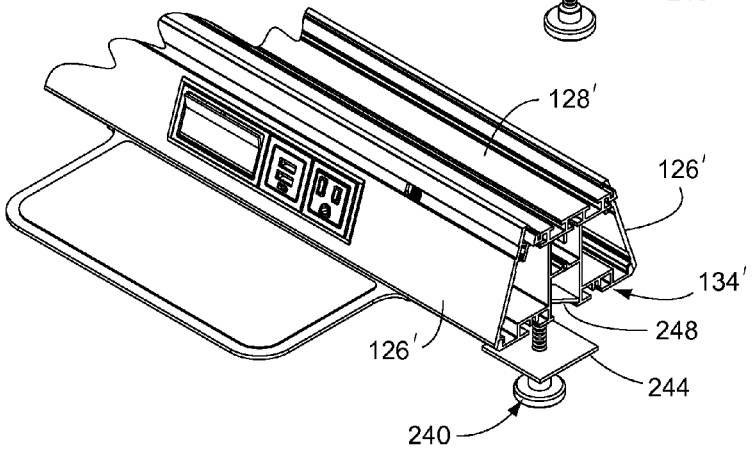
Fig. 35C

TABLE COUPLING SYSTEM WITH POWER AND DATA

CROSS REFERENCE TO RELATED APPLICATIONS

The present application claims the priority benefit of U.S. provisional application Ser. No. 61/713,481, filed Oct. 12, 2012, and of U.S. provisional application Ser. No. 61/832,724, filed Jun. 7, 2013, both of which are hereby incorporated herein by reference in their entireties.

FIELD OF THE INVENTION

The present invention relates to furniture benching or coupling systems, and to electrical power and/or electronic data systems for use in work areas.

BACKGROUND OF THE INVENTION

Work surface coupling or "benching" systems are typically used for coupling two or more work surfaces (such as desk, tables, or the like) together, such as in an office or other work environment, or in study areas such as libraries and the like. Such systems provide a more secure and stable work area, and can allow for more efficient space usage. Some benching systems may include wiring trays that can support wiring (such as below a work surface) to supply power or data outlets located at or near the work surface.

SUMMARY OF THE INVENTION

The present invention provides a work surface benching or coupling system including an elongate joining member or work surface coupler that can mechanically connect to one or more work tables, desks, or the like, while also providing power and/or data outlets, with a wiring passageway inside of a housing, and with the option of mounting a work surface accessory such as a shelf or privacy wall. The benching or coupling system is a substantially self-contained unit including a housing made up of one or more extruded sections that can be cut or formed to substantially any length according to the length of the work surfaces to be joined, or for joining multiple work surfaces along a single elongate joining member. The power and/or data outlets may be provided along an upper portion of the joining member, such as above the tables or desks, or they may be provided along a lower portion of the joining member, such as below a lower surface of the tables or desks. The power and/or data outlets may be provided in substantially any desired quantity, location, or arrangement. Likewise, the elongate joining member may be configured for mounting work surface accessories above the work surface (e.g., shelving, lighted accessories, privacy panels, etc.) and/or below the work surface (e.g., shelving, modesty panels, etc.). The wiring passageway may be disposed between the work surfaces, so that the wiring and its storage space does not occupy space above or below the work surfaces.

In one form of the present invention, a work surface coupling system has power and/or data access, and includes an elongate housing, at least one power or data outlet supported at the housing, a work surface coupler, and a support pad coupled to the housing. The housing is configured to be positioned along a work surface, and has upper and lower portions, and left and right side portions. The work surface coupler is located at or below the lower portion of the elongate housing, and is made to couple or attach to an outer perimeter edge portion of the work surface. The support pad extends laterally outwardly beyond one of the left and right side portions of the elongate housing, and is configured to engage an upper surface or portion of the work surface.

In another form of the present invention, a work surface coupling system has power and/or data access, and includes an elongate housing, at least one power or data outlet supported at the housing, a work surface coupler, and at least one removable side panel. The housing is configured to be positioned along a work surface, and has upper and lower portions, and left and right side portions. The work surface coupler is located at or below the lower portion of the elongate housing, and is made to couple or attach to an outer perimeter edge portion of the work surface. The removable side panel forms one side portion of the housing, and supports the power or data outlet(s).

In one aspect, the elongate housing defines an internal passageway that is shaped or configured to receive wiring associated with the at least one power or data outlet.

In another aspect, the upper portion of the elongate housing includes an accessory coupling surface that is configured to be engaged by a work surface accessory.

In still another aspect, the work surface coupler is configured to releasably engage respective outer perimeter edge portions of two adjacent work surfaces, so that the work surface coupler joins or couples the adjacent work surfaces together. Optionally, the work surface coupler includes a pair of generally C-shaped channels that are configured to receive respective ones of the outer perimeter edge portions of the two adjacent work surfaces. Optionally, the work surface coupler includes movable lower coupler portions that engage respective lower surfaces of the two adjacent work surfaces. For example, the movable lower coupler portions may be any one or more of a threaded fastener, a screw clamp, a ratchet clamp, and a resilient clip.

In yet another aspect, the elongate housing includes at least one support structure element, an elongate rail member, and left and right side panels. The support structure element is configured to be positioned above the work surface, and has an upper portion, a lower portion, a left side portion, and a right side portion. The lower portion of the support structure element forms the lower portion of the elongate housing, and the support structure element also defines an internal passageway that can receive wiring associated with the power or data outlets. The elongate rail member is located at the upper portion of the support structure element, and forms the upper portion of the elongate housing. The left and right side panels are coupled to the left and right side portions of the support structure, with the left and right side panels forming the left and right side portions of the elongate housing.

Optionally, each of the support structure element, the elongate rail member, and the left and right side panels are made from extruded sections that can be cut to a desired length.

In a further aspect, the work surface coupling system includes at least two of the support pads that are coupled to the lower portion of the support structure element, and are arranged on opposite sides of the elongate housing. Each of the support pads extends laterally outwardly beyond a respective one of the left and right side panels, so as to overly two different work surfaces. Optionally, at least one of the power or data outlets is coupled to each of the left and right side panels, and the support pads are positioned directly below respective ones of the power or data outlets.

In a still further aspect, the work surface coupling system includes at least two of the support structure elements coupled together in a longitudinally-aligned arrangement. Optionally, the system further includes a junction piece for coupling the elongate housings together in an end-to-end or longitudinally-aligned arrangement. Optionally, the junction piece includes a central portion and a pair of outboard portions, where at least one of the outboard portions is pivotably coupled to the central portion and is movable to an open position that provides access to the internal passageway.

In a further form of the present invention, a work surface coupling system has power and/or data access, and includes an elongate housing, at least one power or data outlet supported at the housing, a work surface coupler, an accessory coupling surface. The housing is configured to be positioned along a work surface, and has upper and lower portions, and left and right side portions. The work surface coupler is located at or below the lower portion of the elongate housing, and is made to couple or attach to an outer perimeter edge portion of the work surface. The accessory coupling surface is positioned at the upper portion of the housing, and is configured to be engaged by a work surface accessory such as a shelf, a privacy screen, a storage unit, or a lighted accessory such as an electric lamp.

In yet another form of the present invention, a work surface coupling system has power and data capability, and includes at least one support structure element, left and right side panels, and a work surface coupler. The support structure element has upper and lower portions, and left and right side portions, and it defines an internal passageway. The left and right side panels are coupled to the left and right side portions of the support structure, and least one of the side panels is configured to support at least one power or data outlet. The internal passageway of the support structure element is configured to receive electrical wiring associated with the at least one power or data outlet. The work surface coupler is located at the lower portion of the support structure, and is configured to join or couple together two work surfaces.

In one aspect, the work surface coupling system includes a support pad that is coupled to the support structure element and extends laterally outwardly beyond one of the side panels. The support pad is configured to engage an upper surface of one of the work surfaces.

In another aspect, the system includes at least two of the support structure elements in spaced arrangement, with the left and right side panels spanning between the spaced-apart support structure elements.

In yet another aspect, the work surface coupling system includes an elongate rail member located at the upper portion of the support structure element. The elongate rail member includes an accessory coupling surface that is configured to be engaged by a work surface accessory. Optionally, the work surface coupling system includes a work surface accessory, such as a shelf, a privacy screen, a storage unit, or a lighted accessory such as an electric lamp.

Optionally, the accessory coupling surface defines at least one elongate slot in the shape of an inverted T. The elongate slot is configured to receive an insert or a rail that is associated with the work surface accessory.

In a further aspect, the work surface coupling system further includes at least two of the support structure elements in spaced arrangement, an elongate rail member, power or data outlets, and a pair of end caps. The elongate rail member and the left and right side panels span between the support structure elements. At least one of the power or data outlets is mounted at an opening formed in each of the left and right side panels. The elongate rail member, the left and right side panels, and the support structure elements cooperate to define a housing having opposite end portions, with one of the end caps mounted at each opposite end portion of the housing. The support structure elements, the left and right side panels, and the end caps are configured to be mounted above the first and second work surfaces.

Thus, the benching or coupling system of the present invention provides a substantially self-contained unit that can securely join two or more work surfaces together, while also providing power and/or data outlets near one or more (or all) of the work surfaces, hidden storage for wiring associated with the outlets, and the option of mounting additional work surface accessories, if desired. The system may be installed substantially without the use of tools, and may also be at least partially assembled without tools, and is readily configurable or reconfigurable for different applications and dimensional requirements.

These and other objects, advantages, purposes and features of the present invention will become apparent upon review of the following specification in conjunction with the drawings.

BRIEF DESCRIPTION OF THE DRAWINGS

FIG. 12 is a perspective view of a shorter-length version of the work surface coupling system of FIG. 10;

FIG. 13 is an end elevation of the work surface coupling system of FIG. 11;

FIG. 14 is an opposite end elevation of the work surface coupling system of FIG. 11;

FIG. 35A is a sectional end elevation of a mounting arrangement for securing a work surface coupler to a support structure element;

FIGS. 35B and 35C are perspective views of an end portion of a work surface coupling system, showing two steps of securing the work surface coupler of FIG. 35A;

DESCRIPTION OF THE PREFERRED EMBODIMENTS

Figure 1:
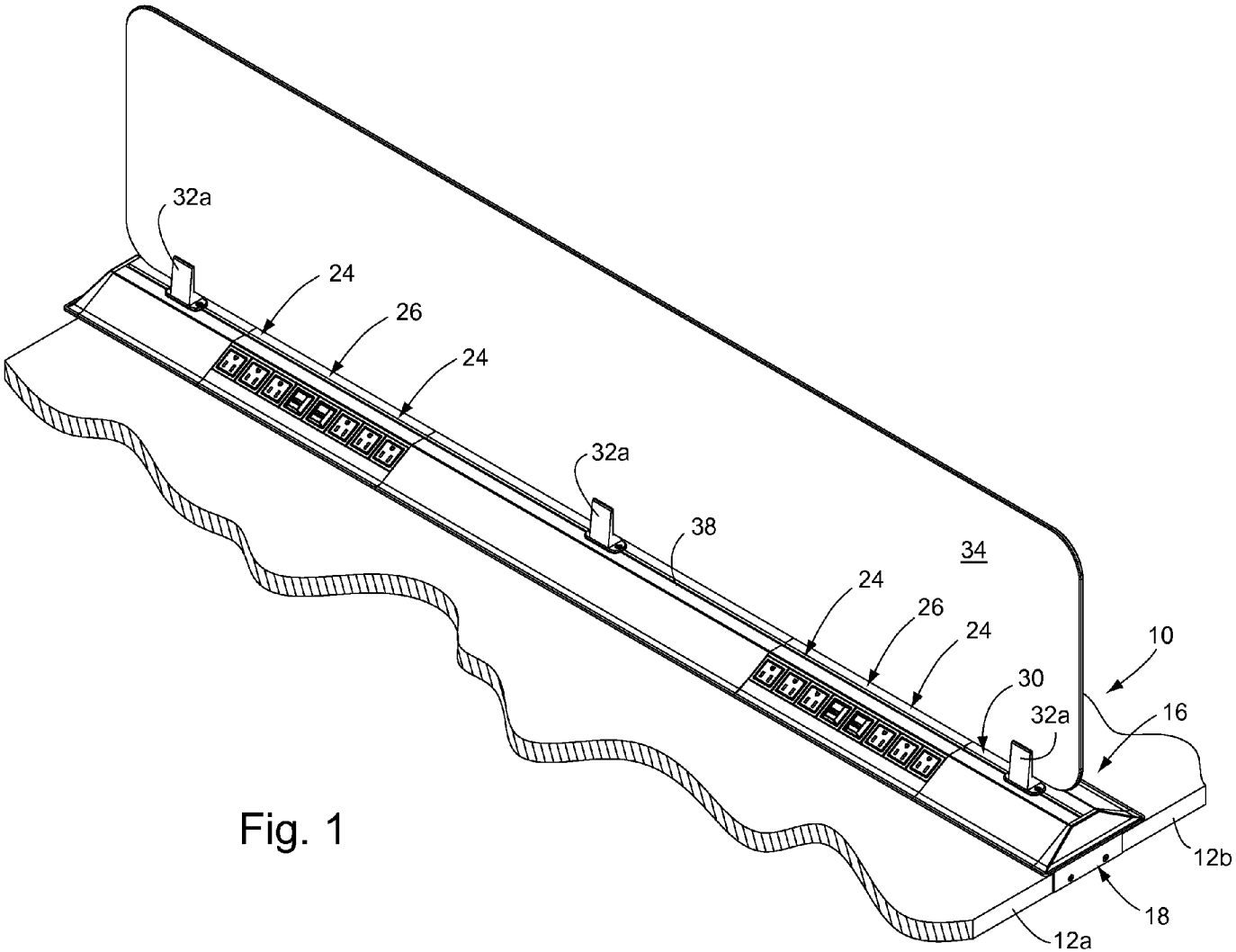
FIG. 1 is a perspective view of a work surface benching or coupling system in accordance with the present invention, shown coupled between a pair of work surfaces and with an upper privacy panel accessory.
Figure 2:
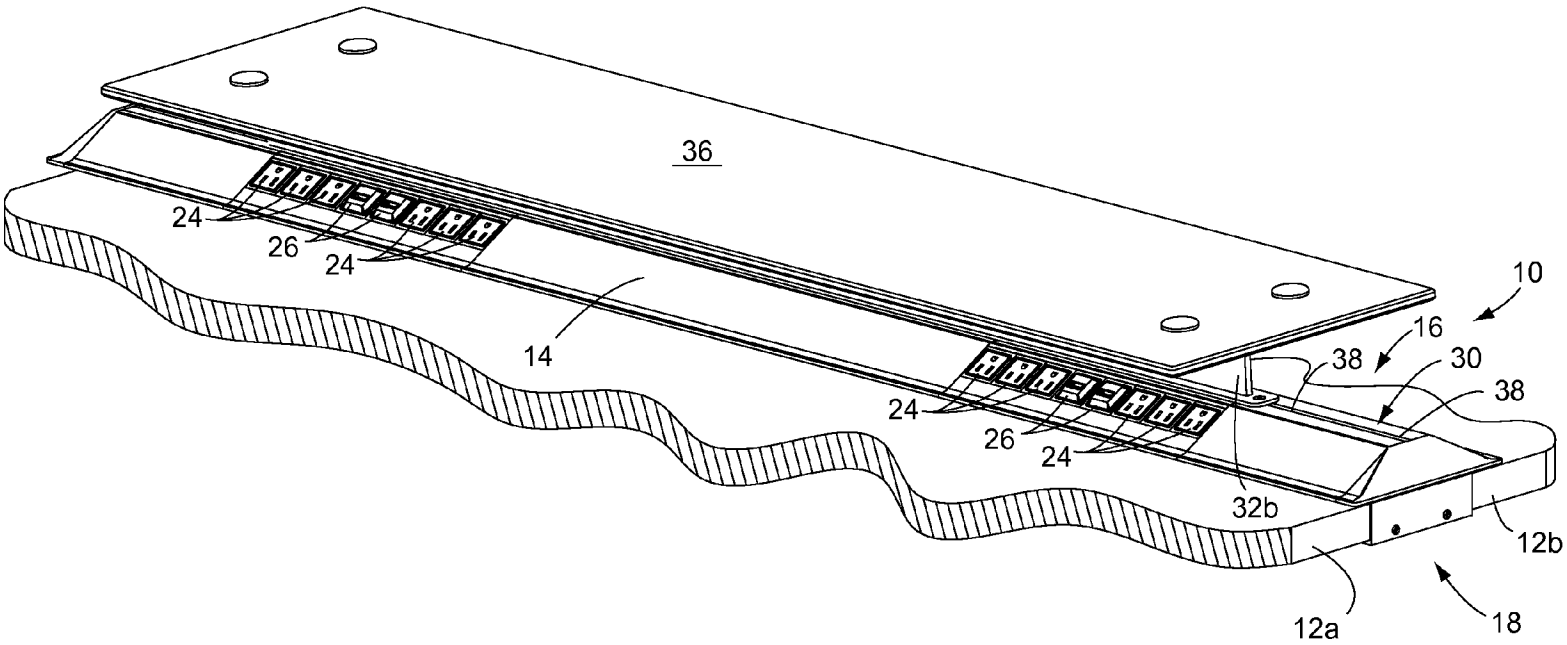
FIG. 2 is a perspective view of another work surface coupling system similar to that of FIG. 1, but shown with an upper shelf or table accessory.
Figure 3:
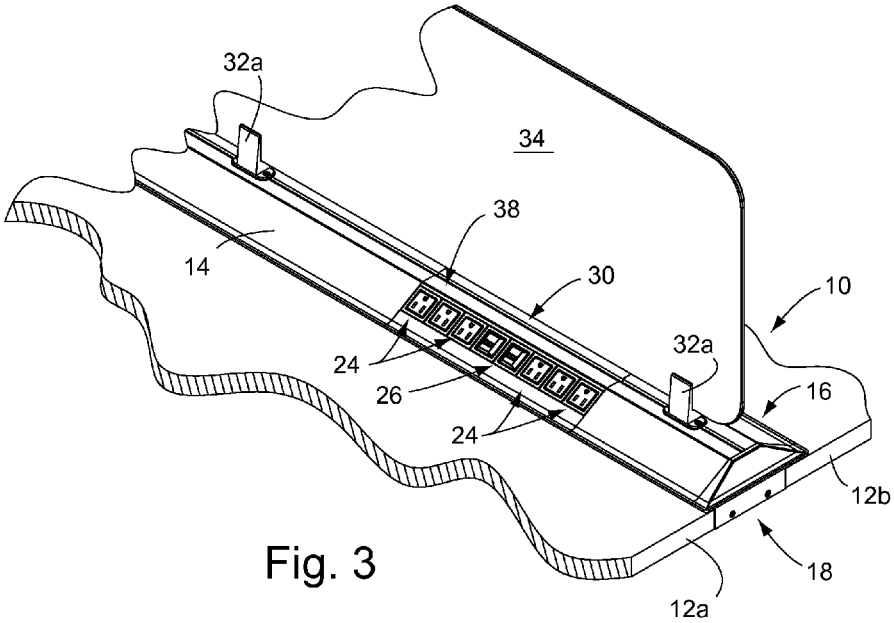
FIG. 3 is an enlarged perspective view of an end portion of the work surface coupling system of FIG. 1.
Figure 4:
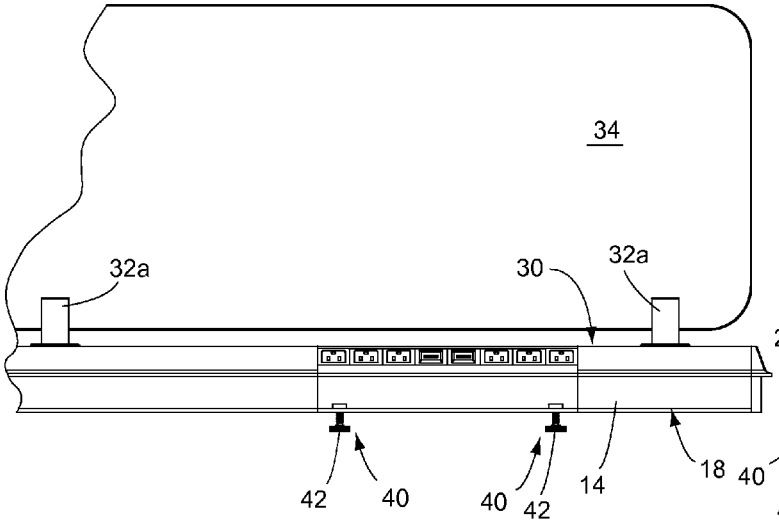
FIG. 4 is a side elevation of the end portion of FIG. 3.
Figure 5:
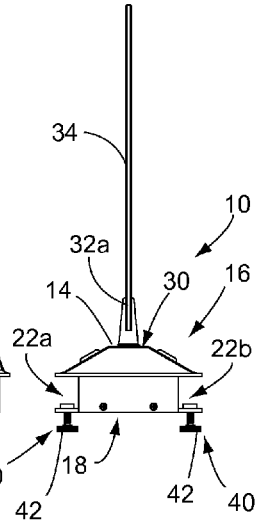
FIG. 5 is an end elevation of the work surface coupling system of FIG. 1.
Figure 6:
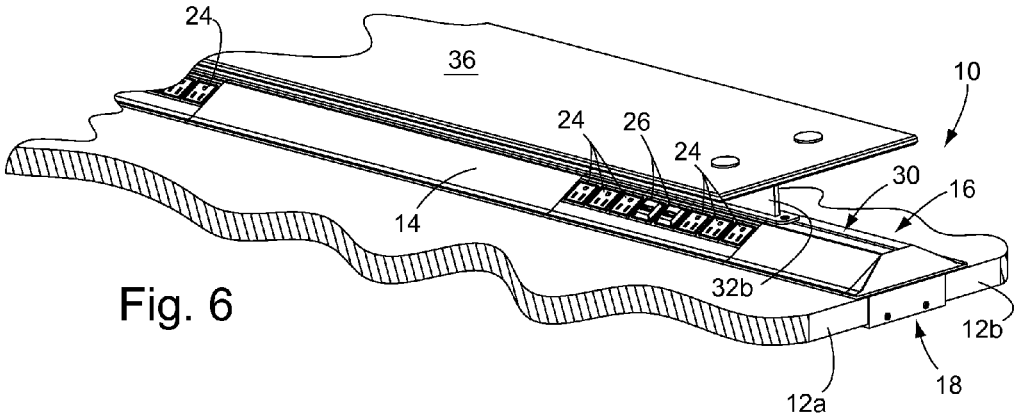
FIG. 6 is an enlarged perspective view of an end portion of the work surface coupling system of FIG. 2.
Figure 7:
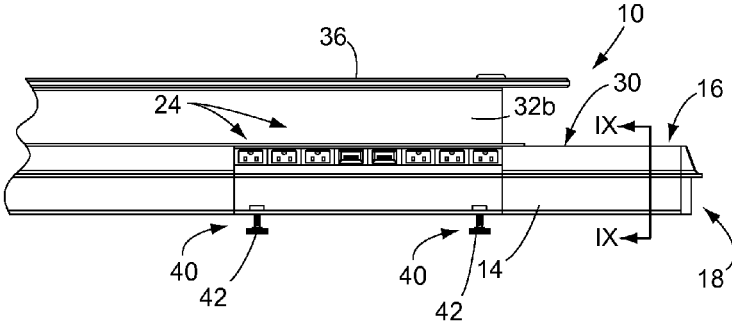
FIG. 7 is a side elevation of the end portion of FIG. 6.
Figure 8:
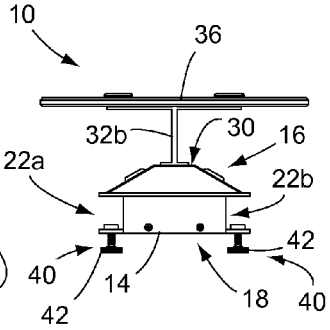
FIG. 8 is an end elevation of the work surface coupling system of FIG. 2.

Referring now to the drawings and the illustrative embodiments depicted therein, a work surface benching or coupling system 10 is provided for mechanically coupling two or more adjacent work surfaces 12*a*, 12*b* such as tables, desks, or the like (FIGS. 1 and 2). Coupling system 10 includes an elongate joining member 14 with an upper housing portion 16 that is positioned generally above work surfaces 12*a*, 12*b*, and a lower portion 18 that is positioned generally between the work surfaces. Elongate joining member 14 defines an internal passageway 20 (FIG. 9) and its lower portion 18 defines two coupling regions 22*a*, 22*b* for coupling joining member 14 to the work surfaces 12*a*, 12*b*, respectively. In the illustrated embodiment, coupling regions 22*a*, 22*b* define generally C-shaped channels for receiving perimeter edge portions of the work surfaces 12*a*, 12*b*, such as shown in FIGS. 1-3 and 6. The elongate joining member 14 is configured to support a plurality of power outlets 24 and data outlets 26 in substantially any desired quantity or arrangement. The internal passageway 20 is configured to receive a plurality of electrical conductors 28 (FIG. 9) associated with the power outlets 24 and data outlets 26.

Upper housing portion 16 of joining member 14 includes an upper coupling region 30 configured to receive a coupler 32 of a work surface accessory that, in the illustrated embodiment of FIGS. 1 and 3-5, is a vertical privacy fence or panel 34 that is supported by three spaced couplers 32*a*, and in the illustrated embodiment of FIGS. 2 and 6-9, is a horizontal shelf or table 36 supported by a single elongate coupler 32*b*. The upper coupling region 30 of joining member 14 defines an elongate channel 38 between two spaced upper surfaces in the coupling region 30, such as shown in FIGS. 1-3, 6, and 9. The couplers 32*a*, 32*b* are configured to be releasably secured to upper coupling region 30 of joining member 14, such as by clamping to the spaced upper surfaces on either side of elongate channel 38. Optionally, other work surface accessories are envisioned, such as modesty panels, lighted accessories, storage devices, displays, or the like, such as will be described in more detail below.

Coupling regions 22*a*, 22*b* include respective sets of clamping members 40 (FIGS. 5 and 8) that, in the illustrated embodiment of FIGS. 1-9, are configured to engage a lower surface of the perimeter edge portion of a respective one of the work surfaces 12*a*, 12*b* by grasping and rotating lower thumbscrews 42 to tighten the clamps and thereby secure the work surfaces together. The clamping members 40 may be loosened by rotating in the opposite direction, such as to allow separation of the work surfaces and/or removal of coupling system 10. It is envisioned that other types of mechanical fasteners may be used, such as screws, bolts, or even releasable adhesives, magnetic couplers, or the like.

In the illustrated embodiment of FIGS. 1-9, upper housing portion 16 of joining member 14 is disposed substantially above the work surfaces 12*a*, 12*b*, with lower portion 18 and wiring 28 disposed between the work surfaces. However, it is envisioned that the system could be inverted, such as to provide power and/or data outlets below the work surfaces (optionally providing power or data outlets at the top surface or region also), and adding accessories such as a modesty panel or the like below the work surfaces.

Figure 9:
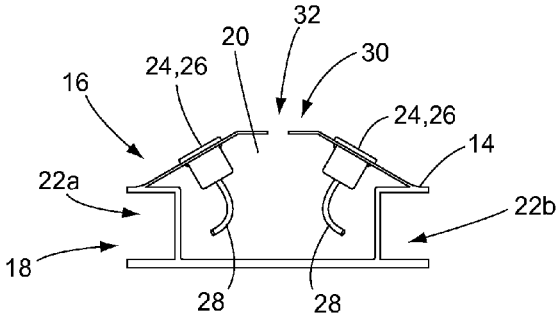
FIG. 9 is an end sectional elevation taken along section line IX-IX in FIG. 7

As shown in FIG. 9, the power outlets 24 and data outlets 26 have rear portions disposed in the internal wiring passageway 20 and front surface portions that are accessible to the outside of the joining member 14. The front surface portions of the power and/or data outlets may be generally flush with an outer surface of the elongate joining member 14, such as the power outlets 24 shown in FIGS. 3 and 6, or may be recessed or may project somewhat outwardly, such as the illustrated data outlets 26. Optionally, the power and/or data outlets may be installed in the joining member 14 which is formed as an extrusion, in a similar manner (such as by sliding) such as shown and described in commonly-owned U.S. Pat. No. 8,480,429, the disclosure of which is hereby incorporated herein by reference. Optionally, the extruded joining member 14 may be cut into multiple sections, with power and data outlet sections inserted between the joining member sections. It should be understood that power outlets 24 are representative of any high or low voltage electrical power outlet or receptacle, such as a 110-volt AC receptacle, a 220-volt AC receptacle, or a DC receptacle in the range of about 2-24 volts, for example, and in any desired receptacle configuration. Similarly, it will be appreciated that data outlets 26 represent any type of digital or analog signal connectors, such as for voice or electronic data communications, audio or video signals, fiber-optic connectors, or the like, without departing from the spirit and scope of the present invention.

Various different methods and components for assembly and accessorizing the work surface coupling systems are envisioned, such as those shown or depicted in FIGS. 10-42. For example, and with reference to FIG. 10, another work surface coupling system 110 may be assembled to a desired length by coupling a plurality of sections 112 together in an end-to-end or series arrangement and attaching them between adjacent sets of work surfaces S. For simplicity, the work surface coupling systems of FIGS. 10-42 will be designated with reference numeral 110, regardless of the number of sections 112 that are used in its construction, as it will be appreciated that a given coupling system may include as few as one section 112 (e.g., FIG. 37C), two sections 112 (e.g., FIGS. 12-18), three sections 112 (e.g., FIGS. 10, 11, 41, and 42), or four or more sections 112, without departing from the spirit and scope of the present invention.

Figure 10:
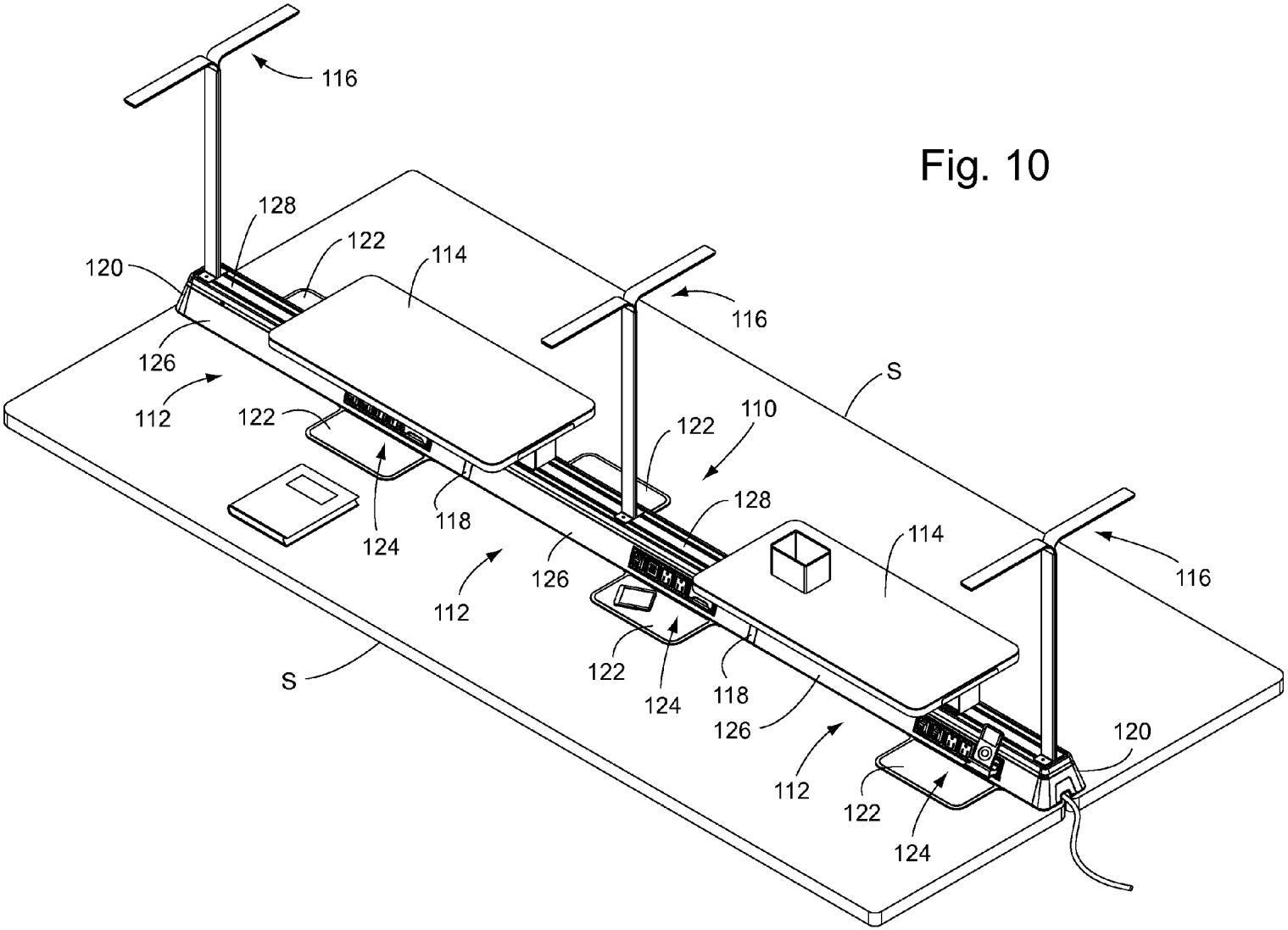
FIG. 10 is a perspective view of another work surface benching or coupling system in accordance with the present invention, shown coupled between a pair of work surfaces and with shelves and lamp accessories supported thereon.
Figure 11:
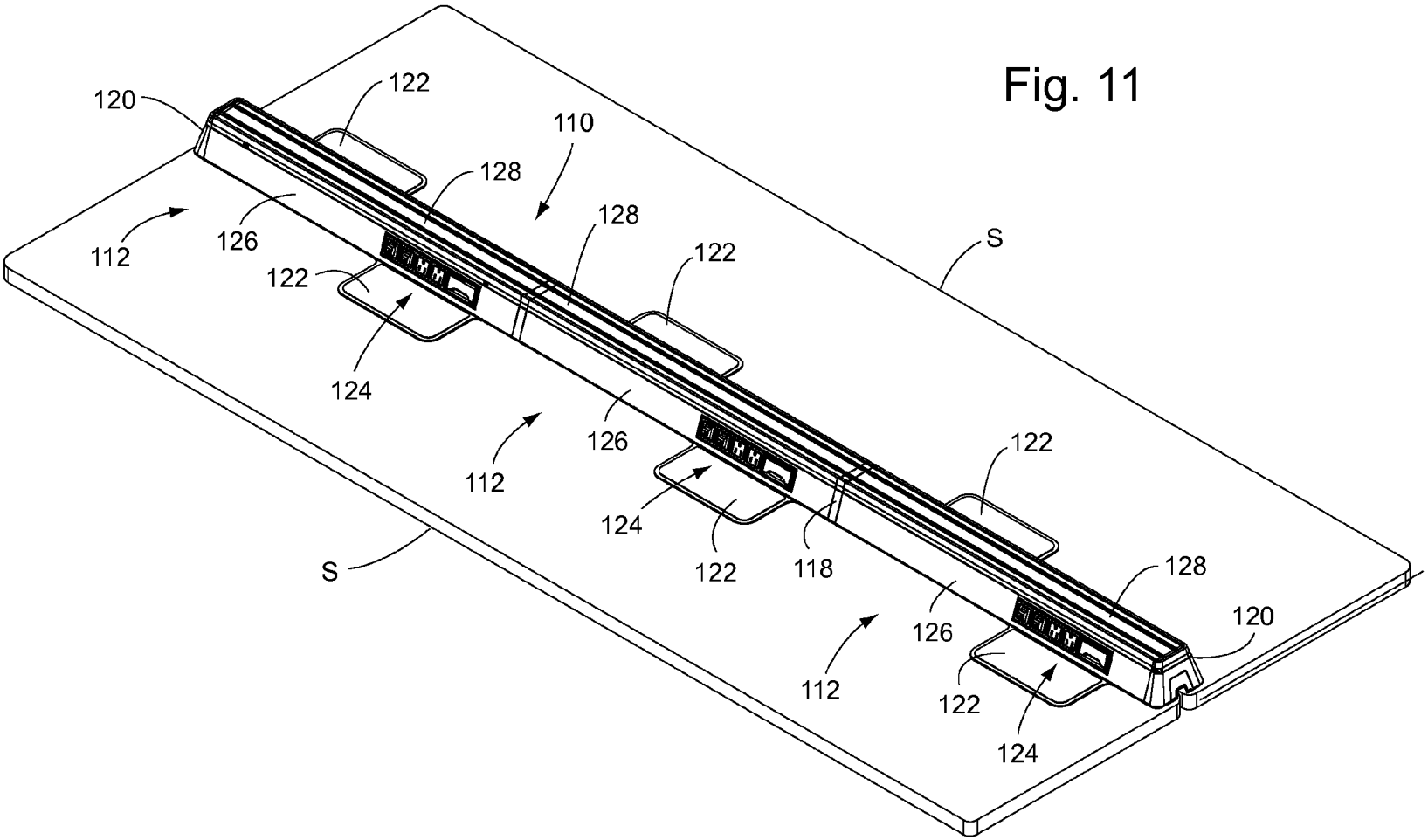
FIG. 11 is a perspective view of the work surface coupling system and work surfaces of FIG. 10, but with the shelves and lamps removed for clarity.

Coupling system 110 can support different types of optional accessories, such as shelves 114, electric lamps 116, and the like (FIG. 10). Each section 112 can be joined to one or more adjacent sections by a junction piece 118, which also may allow access to an interior space of the system, as will be described below. Coupling system 110 presents a finished and clean appearance by substantially avoiding gaps and limiting or eliminating exposed fasteners, and by providing end caps 120 that cover the internal structure of the system. Coupling system 110 further includes support pads 122 in spaced arrangement, such as beneath respective power and/or data units 124 that are mounted along the system. Each section's length can be precisely set or selected by cutting a pair of side panels 126 and a top rail 128 to length prior to assembly. It will be appreciated that at least some embodiments of the coupling system may be assembled in whole or in part with only limited use of tools, such as by employing hand-tight-enable fasteners, snap-together components, adhesive pads, and the like.

A substantial or main portion of coupling system 110 is primarily located above work surfaces S, with work surface couplers or clamping portions 130*a-d* located between and below the work surfaces, such as shown in FIGS. 34A-34D. The main structure of coupling system 110, including its various components and methods of construction, will be described with reference primarily to FIGS. 19A-33. The main above-surface structural component of coupling system 110 is a structural assembly 132 (FIGS. 20 and 22B) that is made up of one or more support structure elements 134 in spaced and longitudinally-aligned arrangement, and with top rail or rail member 128 extending along the top regions of the support structure elements 134. Side panels 126, top rail 128, and one or more support structure elements 134 cooperate to form an elongate housing that is positioned along and generally above a work surface S, or above a pair of adjacent work surfaces. As will be described in more detail below, side panels 126 couple to respective left and right side portions of support structure elements 134, while top rail 128 couples to an upper portion of the support structure elements 134, and a work surface coupler 130*a-e* couples to a lower portion of the support structure elements 134.

Figure 19A:
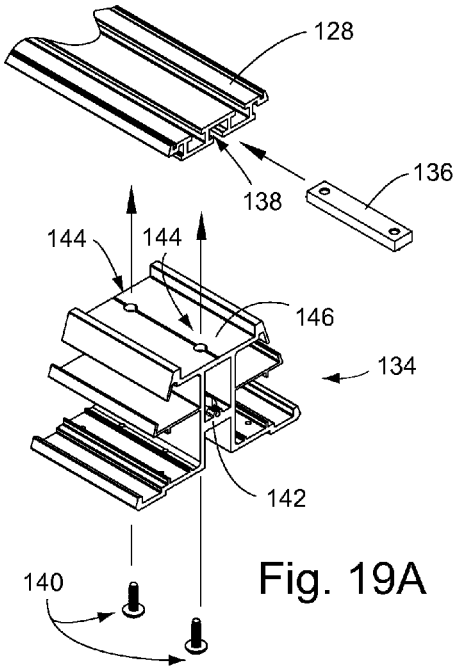
FIG. 19A is a perspective view of a portion of a top rail shown being coupled to a support structure of the work surface coupling system.
Figure 19B:
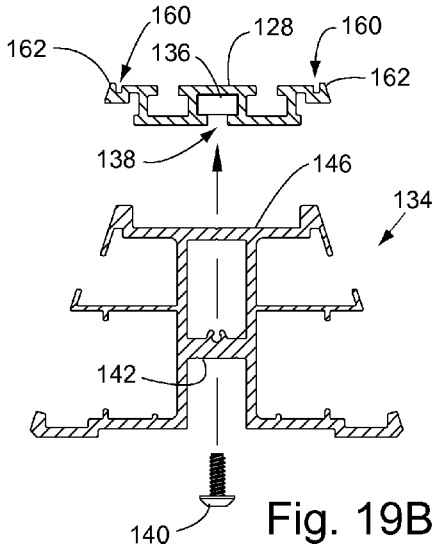
FIG. 19B is a sectional end elevation of the top rail and support structure of FIG. 19A.
Figure 19C:
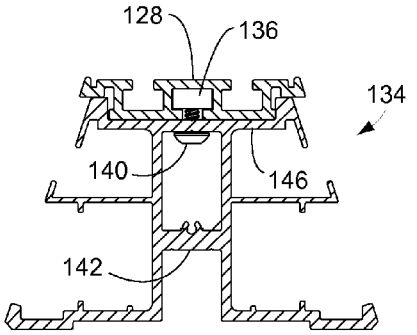
FIG. 19C is another sectional end elevation of the top rail and support structure of FIG. 19A, in which the top rail and support structure have been coupled together via fasteners inserted from below.
Figure 20:
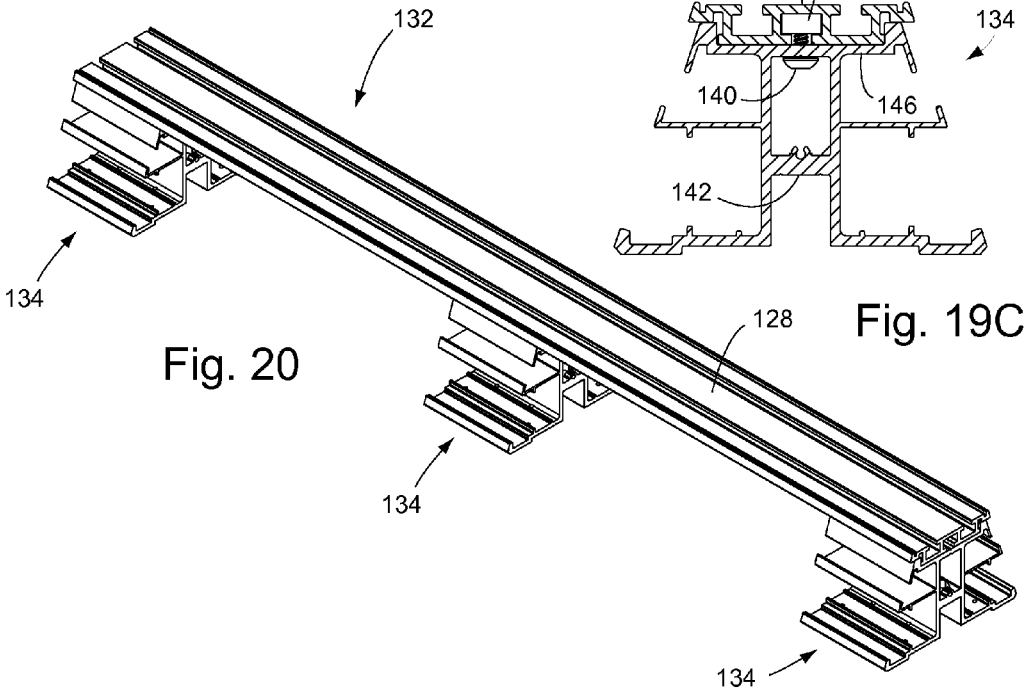
FIG. 20 is a perspective view of the top rail mounted to three support structures in the manner of FIG. 19C.

Top rail 128 may be coupled to support structure elements 134 in various different ways. For example, and as shown in FIGS. 19A and 19B, a threaded insert 136 may be slid into a central channel 138 that is formed in top rail 128, and engaging the threaded insert 136 with threaded fasteners 140 that are passed from below support structure element 134, through respective bores in a horizontal middle wall 142, and through respective bores 144 in a horizontal top wall 146 of support structure element 134. Other coupling methods and hardware are envisioned for securing top rail to support structure elements 134, such as with self-tapping fasteners 148 that are inserted from above through bores 149 in top rail 128 from above, and engage bores 144 in horizontal top wall 146 of structure element 134 (FIG. 21A), or with an adhesive double-sided pad 150 that is sandwiched between top wall 146 and top rail 128 (FIG. 21B), or with separate female fasteners 152 that slide into central channel 138 and are engaged by respective fasteners 140 (FIG. 21C) in substantially the same way that fasteners 140 engage threaded insert 136, described above.

Figure 15:
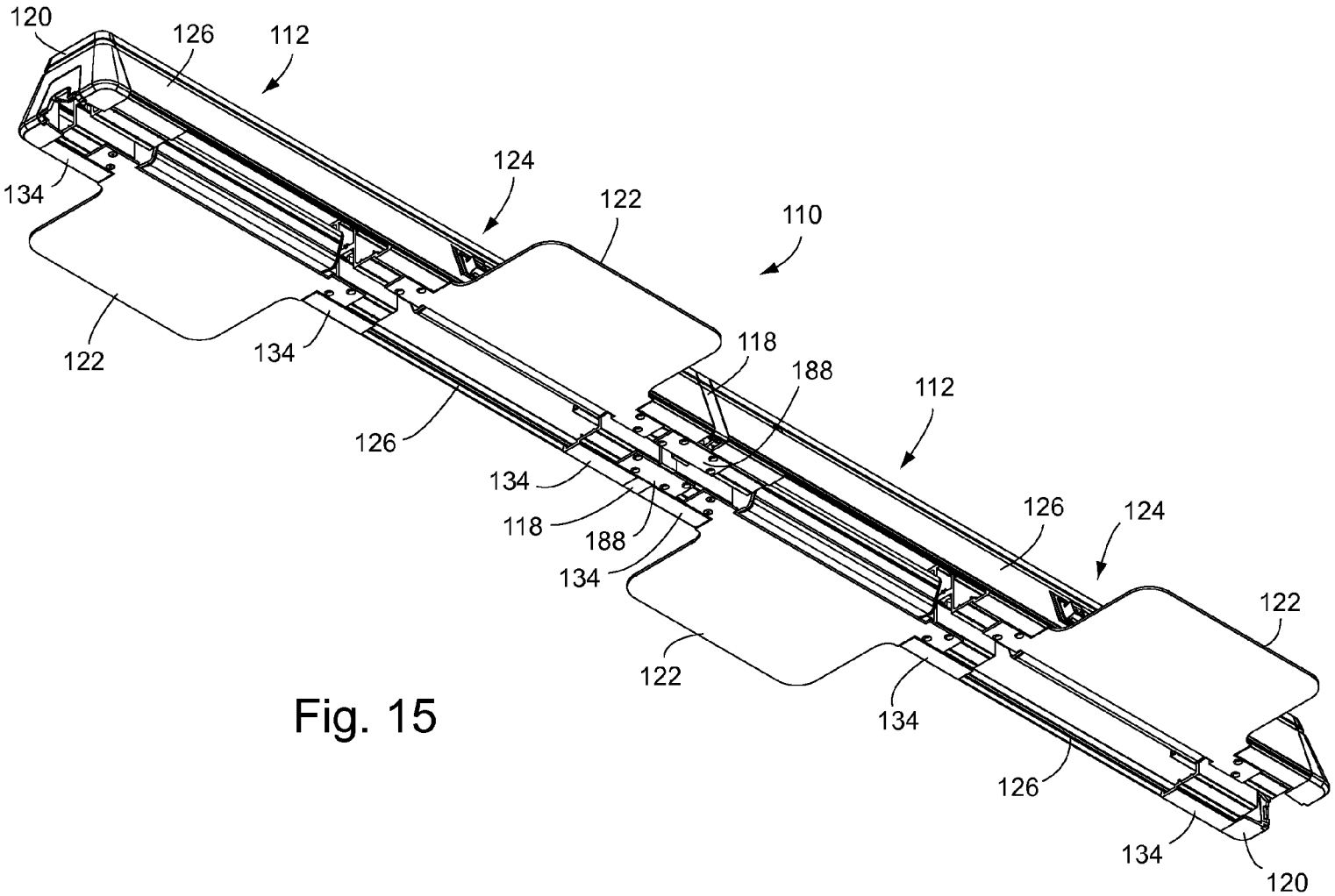
FIG. 15 is a bottom perspective view of the work surface coupling system of FIG. 12.
Figure 16:
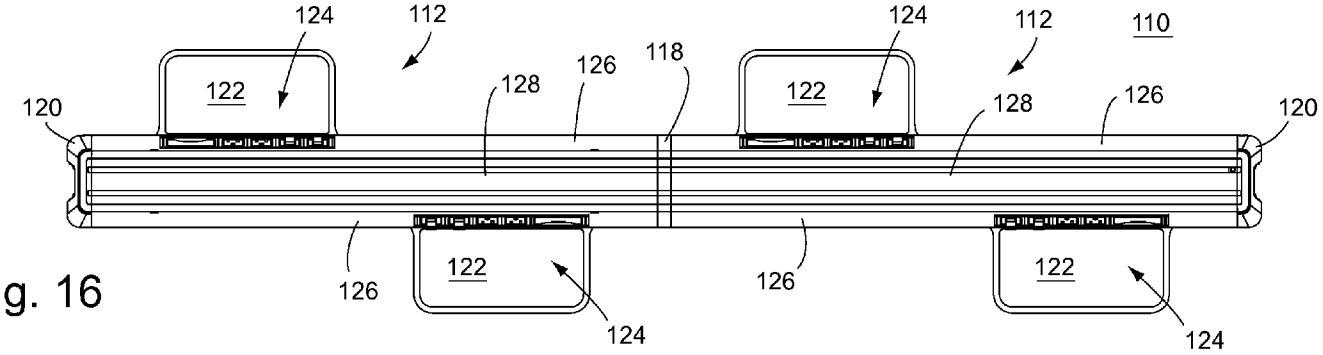
FIG. 16 is a top plan view of the work surface coupling system of FIG. 12.
Figure 17:
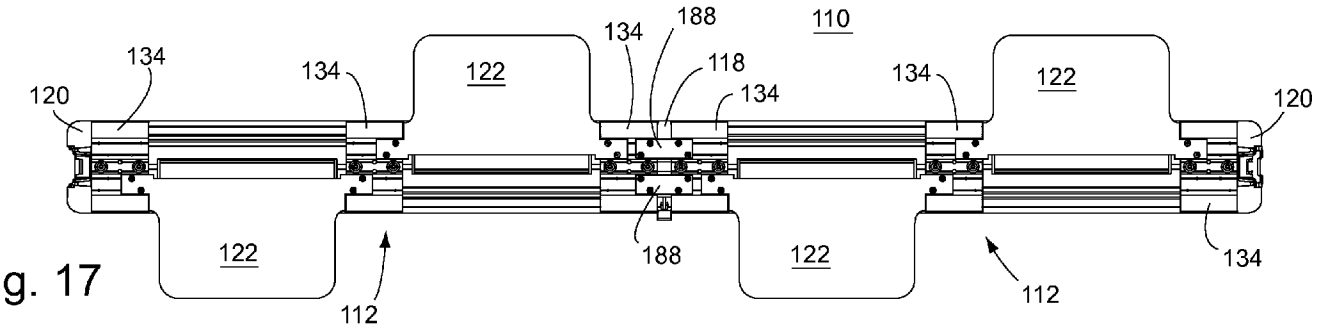
FIG. 17 is a bottom plan view of the work surface coupling system of FIG. 12.
Figure 18:
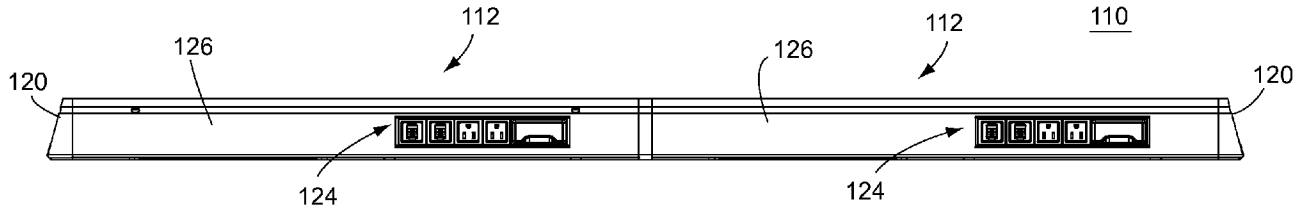
FIG. 18 is a side elevation of the work surface coupling system of FIG. 12.
Figure 41:
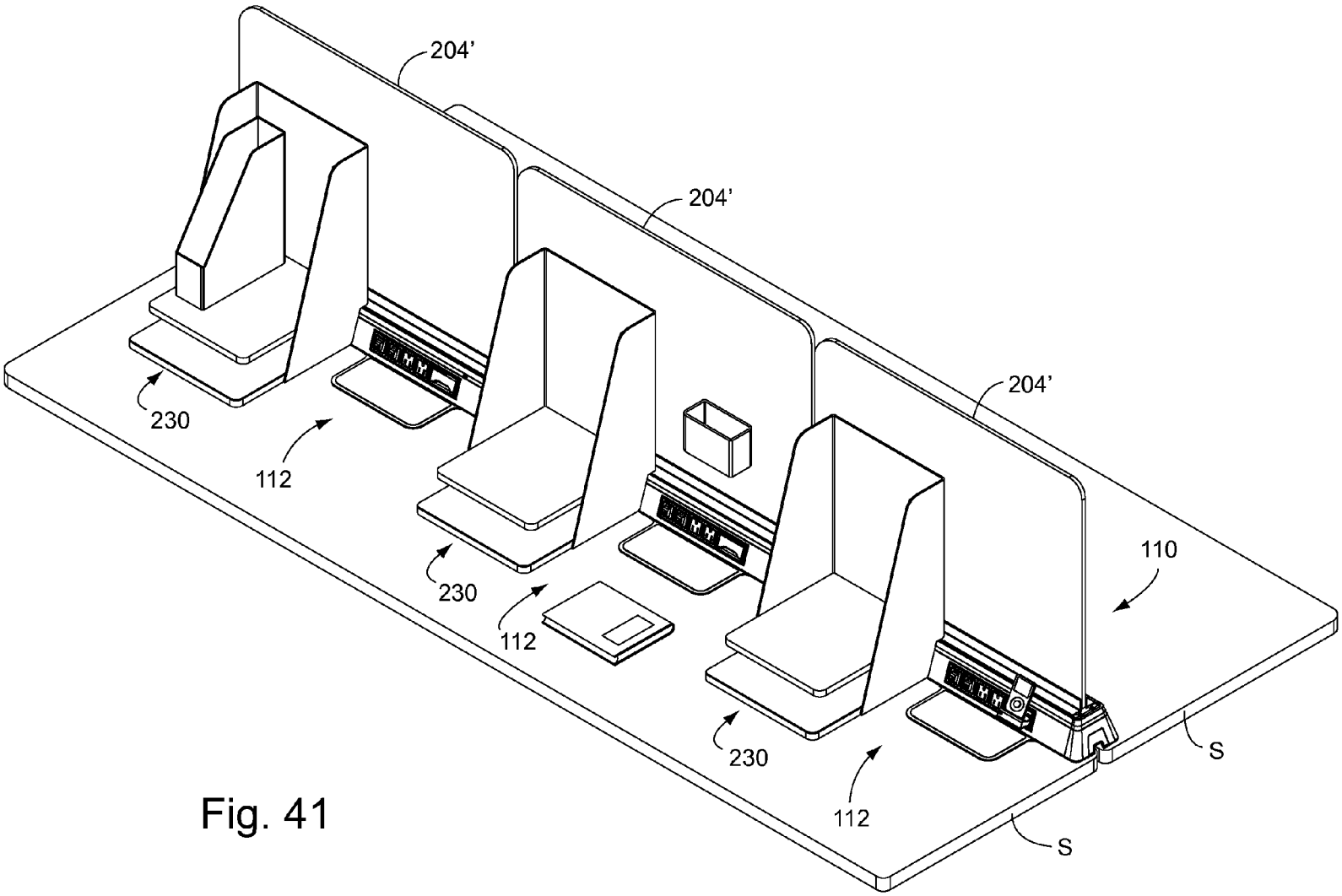
FIG. 41 is another perspective view of the work surface coupling system and work surfaces of FIGS. 10 and 11, but with optional privacy panels installed along the full length of the system, and with optional shelving and storage units coupled along one side thereof, and with a hand-held electronic device shown supported at a charging base of one of the power and data units.
Figure 42:
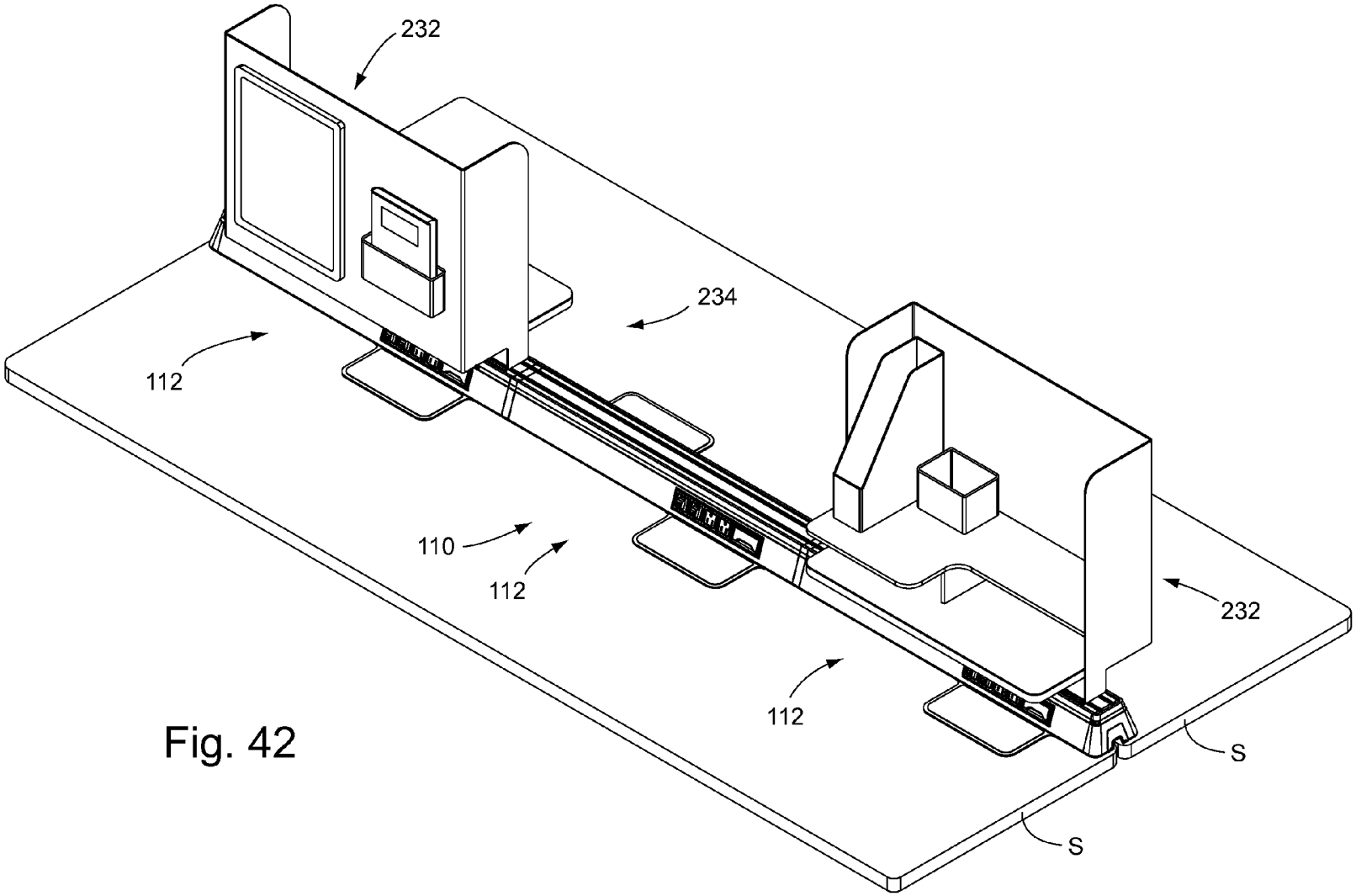
FIG. 42 is another perspective view of the work surface coupling system and work surfaces of FIGS. 10 and 11, but with two optional shelving and storage units installed at opposite ends thereof.

Top rail 128 may be a cut-to-length extruded member made of aluminum alloy, resinous plastic, or other suitable material. While top rail 128 may be cut to the same length as the corresponding side panels, it is envisioned that the top rail 128 could be a one-piece or unitary member for each coupling system. Support structure elements 134 may similarly be extruded, but are typically cut to shorter lengths that are sufficient to provide adequate structural strength when spaced along the finished coupling system 110, and without adding excess weight. Typically, a structure element 134 is placed at each end of a given section 112, such as shown in FIGS. 15 and 17, and then additional structure elements 134 are added at spaced intervals (such as 12-inch, 18-inch, or 24-inch intervals), in order to provide a sufficient amount of strength and rigidity for a given application. Smaller intervals or spacing between structure elements 134 may be appropriate particularly when heavy, tall, or load-bearing optional accessories are to be added atop each section 112, such as shown in FIGS. 10, 41, and 42.

Figure 22A:
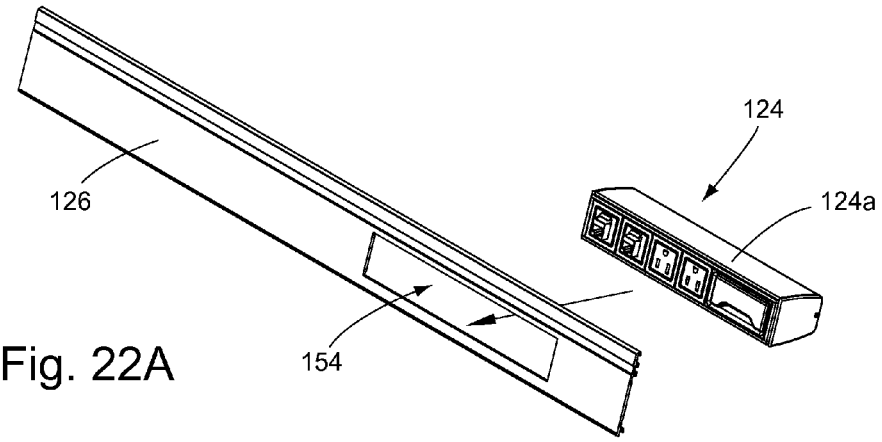
FIG. 22A is a perspective view of a power and data unit being coupled to a side panel of the work surface coupling system.

Power and data units 124 are coupled to their respective side panels 126 from behind (inside) at correspondingly-shaped holes or openings 154 that are formed or established in side panels 126 for that purpose, such as shown in FIG. 22A. Each power and data unit 124 may include snap-together features or latch elements that engage the edges of side panel 126 that define opening 154, or may be secured to side panel 126 via threaded fasteners, an attachment bezel that secures from the outside, or the like.

Figure 22B:
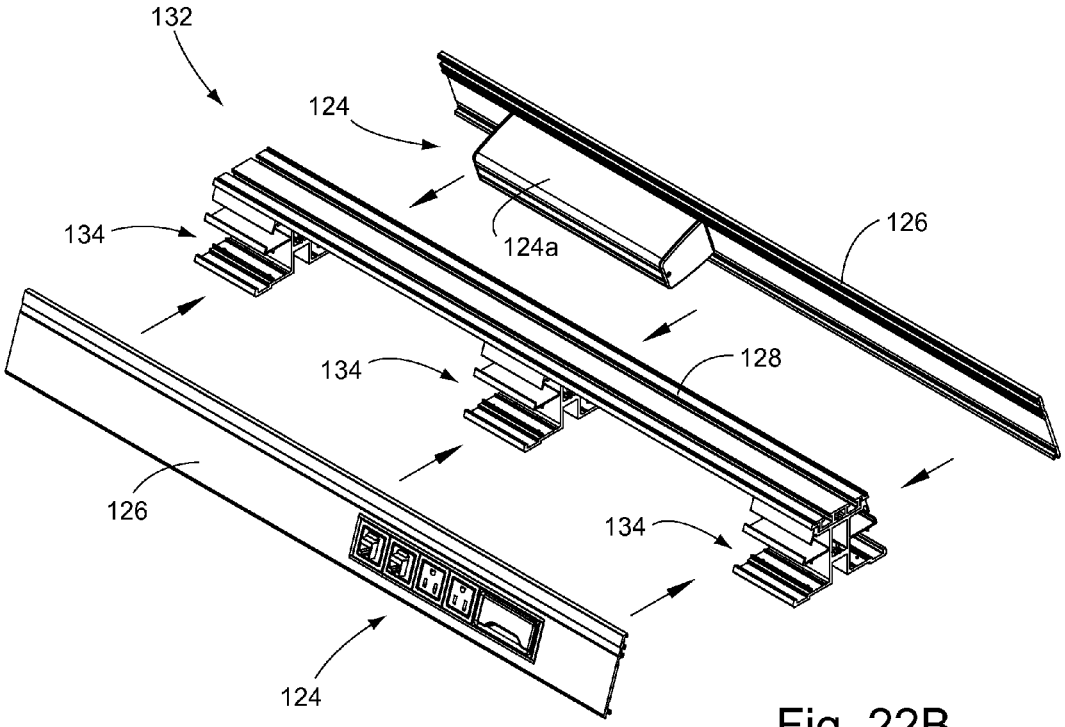
FIG. 22B is a perspective view of two of the combined side panels with power and data units of FIG. 22A, shown being coupled to the top rail and support structures of FIG. 20.
Figure 24A:
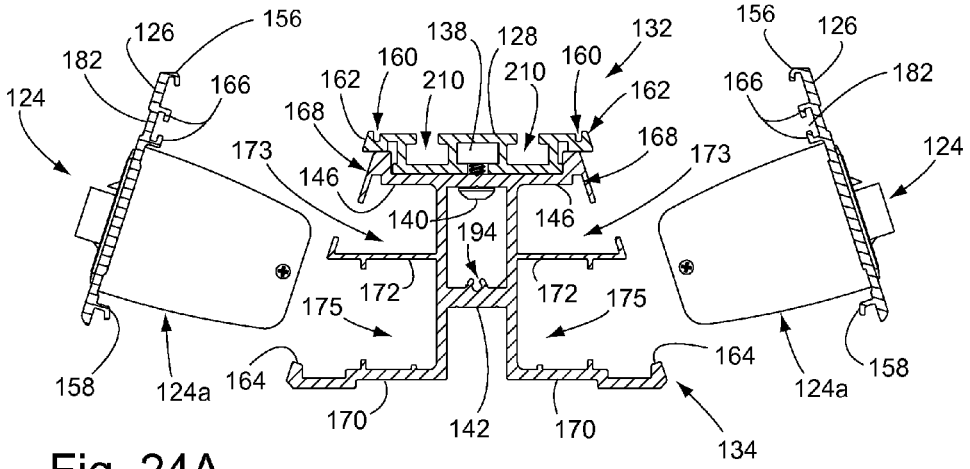
FIGS. 24A-24C are sectional end elevations depicting three steps of the coupling procedure shown in FIG. 23.
Figure 24B:
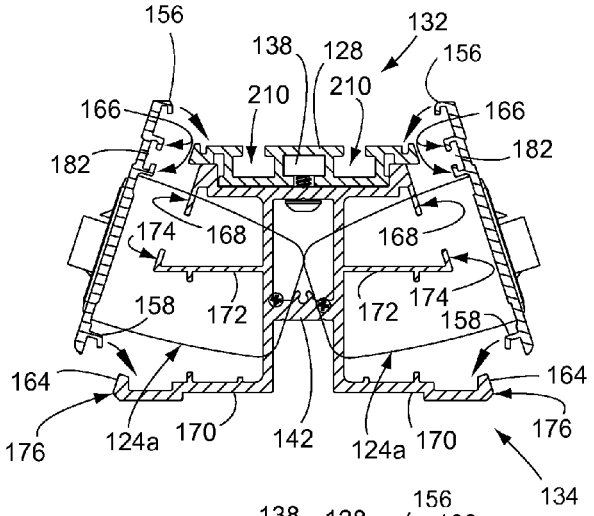
Figure 24C:
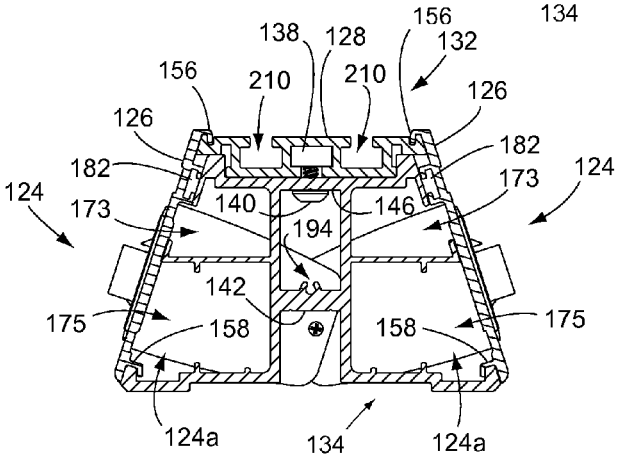

Each side panel 126 is initially secured or supported at the structural assembly 132 via downwardly-angled top hook portions 156 and bottom hook portions 158, such as in a manner that is shown sequentially in FIGS. 24A-24C. Top hook portions 156 engage respective top grooves 160 and edge lips 162 that are formed along the outboard sides of top rail 128 (FIG. 24A), while bottom hook portions 158 engage respective edge lips 164 that are formed along the bottom outboard sides of support structure element 134. Side panels 126 are further supported by inwardly-projecting legs 166 (FIGS. 24A-24C) that engage an angled and generally planar outboard surface 168 at the upper region of each support structure element 134, such as in the manner shown in FIG. 24C. Side panels and power and data units 124 are typically arranged so that rear portions 124*a* of power and data units 124 are received in spaces between the support structure elements 134 of a given structural assembly 132, such as shown in FIG. 22B.

Figure 23:
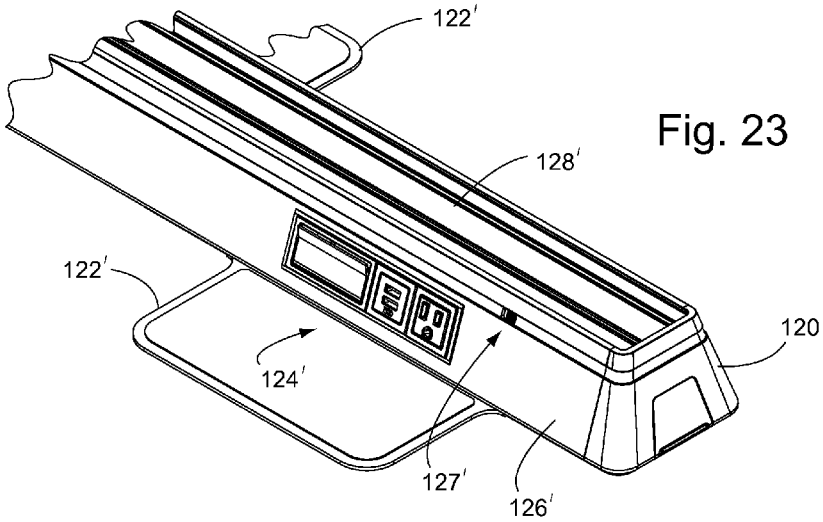
FIG. 23 is a perspective view of an end portion of another work surface benching or coupling system, having a different side panel coupling arrangement.
Figure 23A:
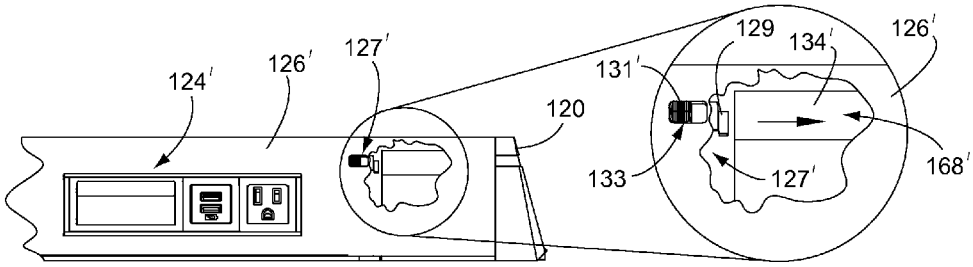
FIGS. 23A and 23B are side elevations of the work surface coupling system of FIG. 23, including cutaway regions with enlarged portions showing operation of a side panel latching mechanism.
Figure 23B:
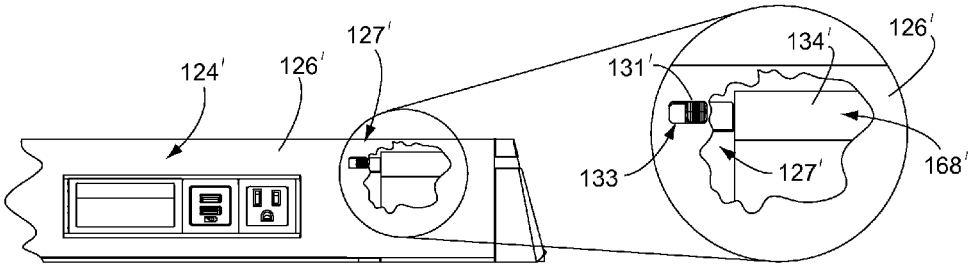

Optionally, and with reference to FIGS. 23-23B, an alternate side panel 126' includes a latch-release mechanism 127' in which a tab 129' (FIG. 23A) is movable from a non-latching position (FIG. 23A) and a latching position (FIG. 23B), in the direction of the arrow in the enlarged view portion of FIG. 23A. Latch-release mechanism 127' further includes a manually-operated thumb switch 131' that is made accessible through a switch opening 133' that is formed or established in side panel 126'. Thumb switch 131' is coupled directly to tab 129' and may be unitarily formed therewith, such as of molded resinous plastic, machined aluminum, or the like. Optionally, thumb switch 131' may be spring-biased to the latching position of FIG. 23B, so that a manual force must be applied to the thumb switch 131' in a longitudinal direction away from support structure element 134', in order to overcome the spring force and friction to move the thumb switch 131' and tab 129' to the non-latching position of FIG. 23A. Releasing the spring-biased switch will allow the switch 131' and tab 129' to return to the latching position.

Figure 21C:
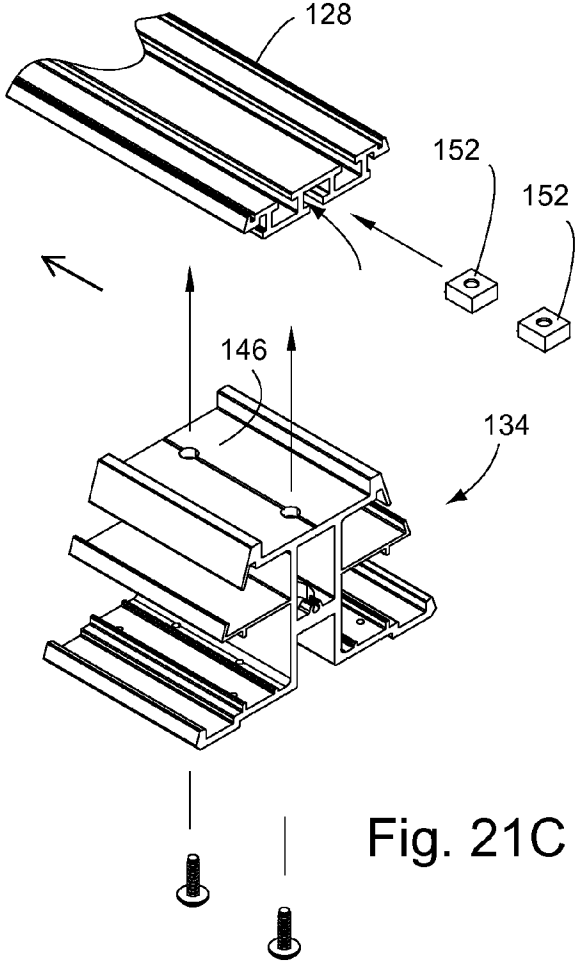
FIG. 21C is a perspective view of the top rail portion and support structure being coupled together via threaded male fasteners disposed along the support structure and corresponding female fasteners disposed along the top rail portion.
Figure 21B:
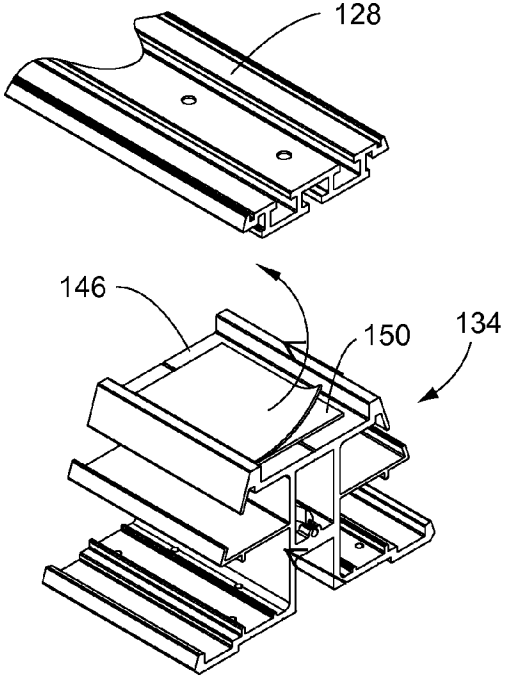
FIG. 21B is a perspective view of the top rail portion and support structure being coupled together via an adhesive pad.
Figure 21A:
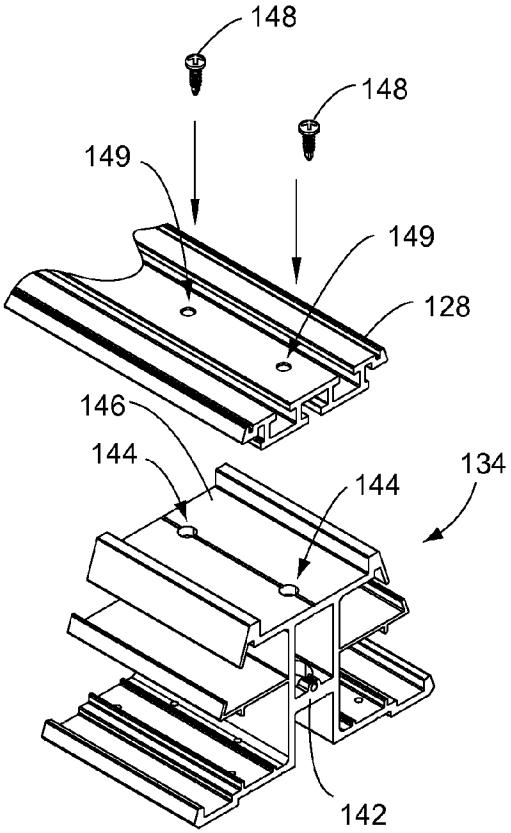
FIG. 21A is a perspective view of the top rail portion and support structure being coupled together via fasteners inserted from above.
Figure 21D:
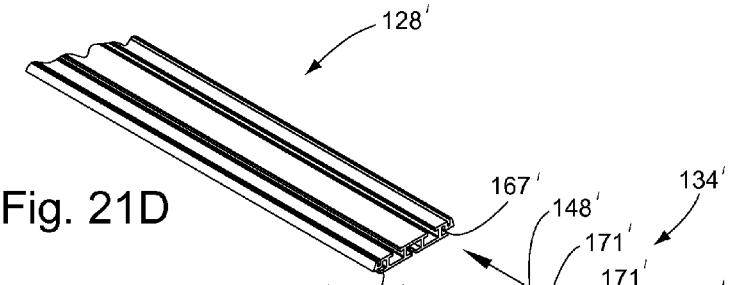
FIG. 21D is a perspective view of another top rail shown being coupled to another support structure of the work surface coupling system.
Figure 21E:
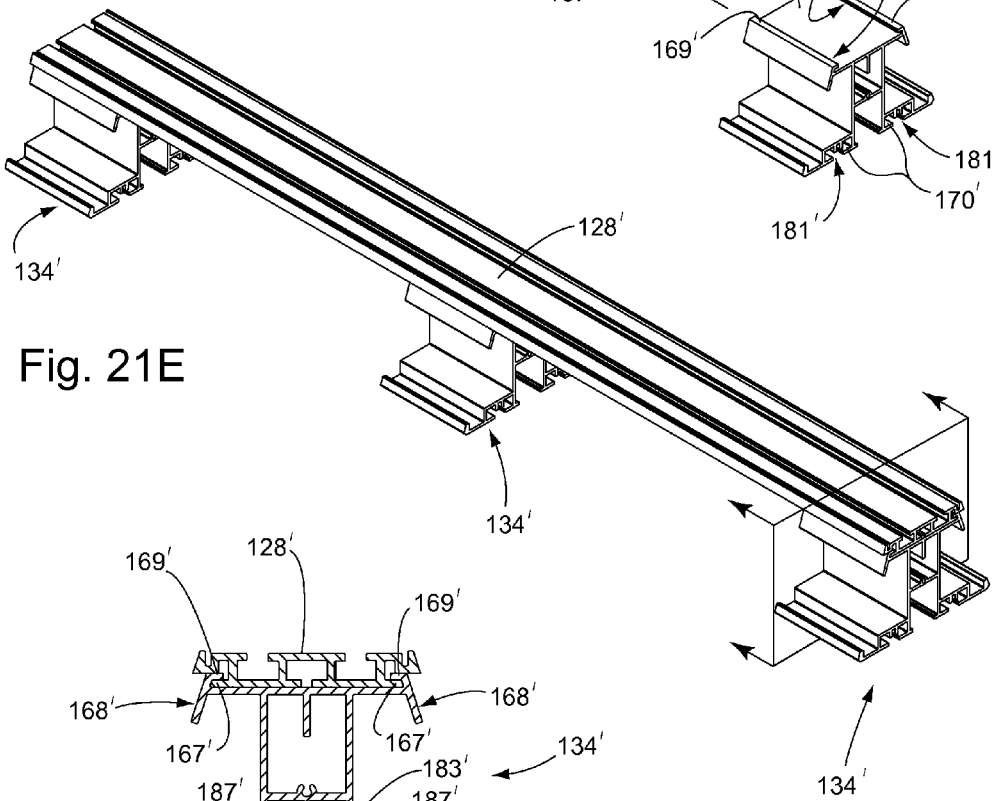
FIG. 21E is a perspective view of the top rail mounted to three support structures in the manner of FIG. 21D.
Figure 21F:
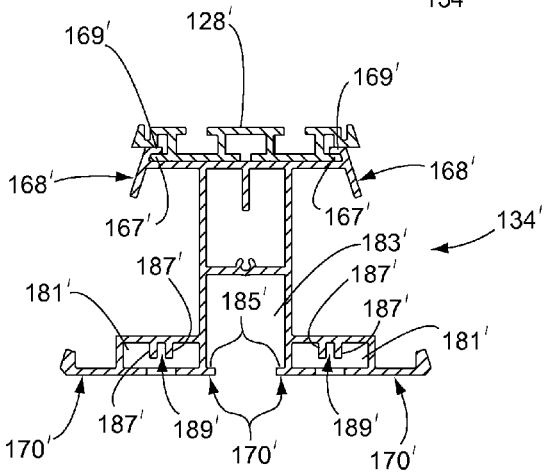
FIG. 21F is an end sectional view of the top rail portion and support structure taken along plane XXI-F in FIG. 21E.

In the latching position of FIG. 23B, the tab 129' engages an end portion of the adjacent support structure element 134', such as along an inboard side of an outboard surface 168' that is shown in FIG. 21F. This engagement of tab 129' secures side panel 126' by preventing it from being pulled laterally away from support structure element 134', while end caps 120 ensure that the side panel 126' cannot be inadvertently slid in a longitudinal direction to disengage the tab 129'. In the non-latching position of FIG. 23A, the tab 129' disengages the support structure element 134' so that side panel 126' may be pulled laterally away from support structure elements 134', although in the configuration shown this would require first lifting the side panel sufficiently to disengage its upper and lower hooks that generally correspond to hooks 156, 158 of support structure element 134. This lifting motion is possible only when the tab 129' is in the non-latching position. The side panel 126' may be re-installed in the reverse order of its removal. Optionally, the tab 129' may have a beveled end portion so that engagement of the beveled end of the tab with the outboard surface 168' of support structure element 134', combined with an inwardly-directed force applied to the outboard surface of side panel 126', will momentarily bias the tab to its non-latching position. Further application of force will cause the side panel 126' to move fully against the support structure element and allow the spring to bias the tab 129' back to its latching position, thus securing the side panel in place.

In the illustrated embodiment of FIGS. 19A-19C, 21A-21C, and 24A-24C, support structure elements 134 have sloped outboard surfaces so that side panels 126 are sloped inwardly from bottom to top, which provides convenient access to electrical and/or data receptacles at power and data units 124. In addition to horizontal middle wall 142 and horizontal top wall 146, support structure elements 134 include a pair of generally horizontal bottom walls 170 (which define or form edge lips 164 at their outboard ends), and a pair of generally horizontal outboard middle walls 172 between top wall 146 and bottom walls 170, such as shown in FIGS. 24A-24C. Outboard middle walls 172 have outboard surfaces 174, and bottom walls 170 have outboard surfaces 176, with outboard surfaces 174, 176 positioned to engage respective inner surface portions of respective side panels 126 when assembled, such as shown in FIG. 24C. In this manner, outboard surfaces 174, 176, and outboard surfaces 168, all engage and support side panels 126 at support structure elements 134.

Figure 33:
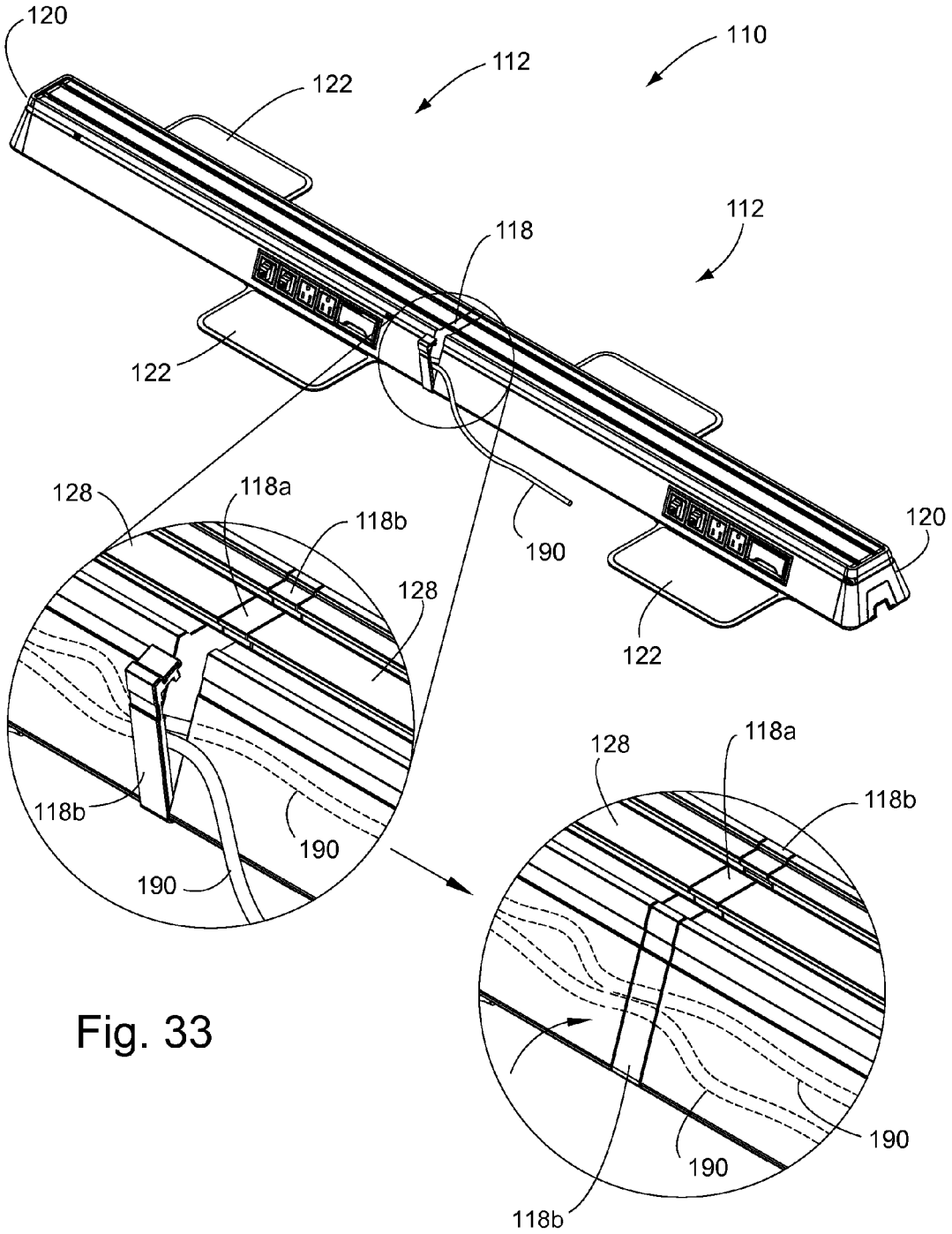
FIG. 33 is another perspective view of the work surface coupling system of FIG. 12, and depicting a wiring pass-through, with two enlarged portions provided for clarity.

An internal passageway in the form of an elongate upper channel 173 is defined between horizontal top wall 146 and each horizontal outboard middle wall 172, while another internal passageway, in the form of an elongate lower channel 175, is defined between each horizontal outboard middle wall 172 and each corresponding horizontal bottom wall 170, such as shown in FIGS. 24A-24C. Channels 173, 175 provide space to route high and/or low voltage wiring, such as shown in FIG. 33, and also provide space for electrical connectors, such as those available from Anderson Power Products Inc., of Sterling, Mass. Such wiring may be bundled or run separately, and provisions may be made to isolate low and high voltage wiring, for example, such as to reduce electrical interference in sensitive data lines or the like.

Optionally, a top rail 128' and corresponding support structure elements 134' may be configured to securely engage one another via the engagement of cooperative surfaces or elements, and without the use of separate mechanical fasteners, such as shown in FIGS. 21D-21F. Support structure elements 134' are shaped similarly to the support structure elements 134 described above, but include a pair of inwardly-directed ribs 169' on opposite sides of an upper horizontal wall 148', and which partially overlie the upper horizontal wall 148'. Ribs 169' cooperate with upper horizontal wall 148' to define respective channels 171' that are shaped to slidably receive a corresponding pair of outwardly-directed ribs 167' at a lower region of the top rail 128'. Once top rail 128' is engaged with the support structure elements 134' in this manner (FIGS. 21E and 21F), the top rail 128' cannot be lifted off of the support structure elements 134', and the pieces must instead be slid apart in their longitudinal direction.

Support structure elements 134' also have generally horizontal bottom walls 170' that define mounting slots 181' for receiving mounting hardware or components, similar to the manner of the outboard slots 210 of the top rail 128, as will be described below. Each support structure element 134' further defines a central lower channel 183' and a pair of inwardly-directed elongate shoulders or ledges 185' at the bottom of central lower channel 183' (FIG. 21F). Central lower channel 183' and elongate shoulders 185' may optionally be used for securing the support structure elements 134' to a work surface coupler, as will be described below. In addition, each support structure element 134' includes a pair of ribs 187' that extend longitudinally along an upper region of mounting slots 181' and define an elongate screw-receiving channel 189' that is open at its lower end (FIGS. 21F and 35A). Ribs 187' are also optionally usable for securing the support structure elements 134' to a work surface coupler, as will be described below. In other respects, top rail 128' and support structure elements 134' are similar to top rail 128 and support structure elements 134, such that their various features and functions may be readily understood with reference to the above descriptions.

Support pads 122 provide resting surfaces for objects such as portable electronic devices, and also enhances the rigidity of the finished coupling systems 110 by resisting bending or torsional stresses applied to top rail 128, such as due to a side load applied to a divider wall, lamp, shelf, or the like, which may be attached to top rail 128. Because support pads 122 may project a substantial distance laterally outwardly from respective side panels 126, the support pads are well suited to enhance the system's rigidity and, in effect, may act like "outriggers" as they contact an upper surface of a given work surface S, thereby resisting such forces or loads that may be applied to the system. Support pads 122 may be coupled directly to horizontal bottom walls 170 of support structure elements 134 (FIG. 25), and may span the distance or space between structure elements 134 such as in the manner shown in FIGS. 15 and 17.

Figure 25:
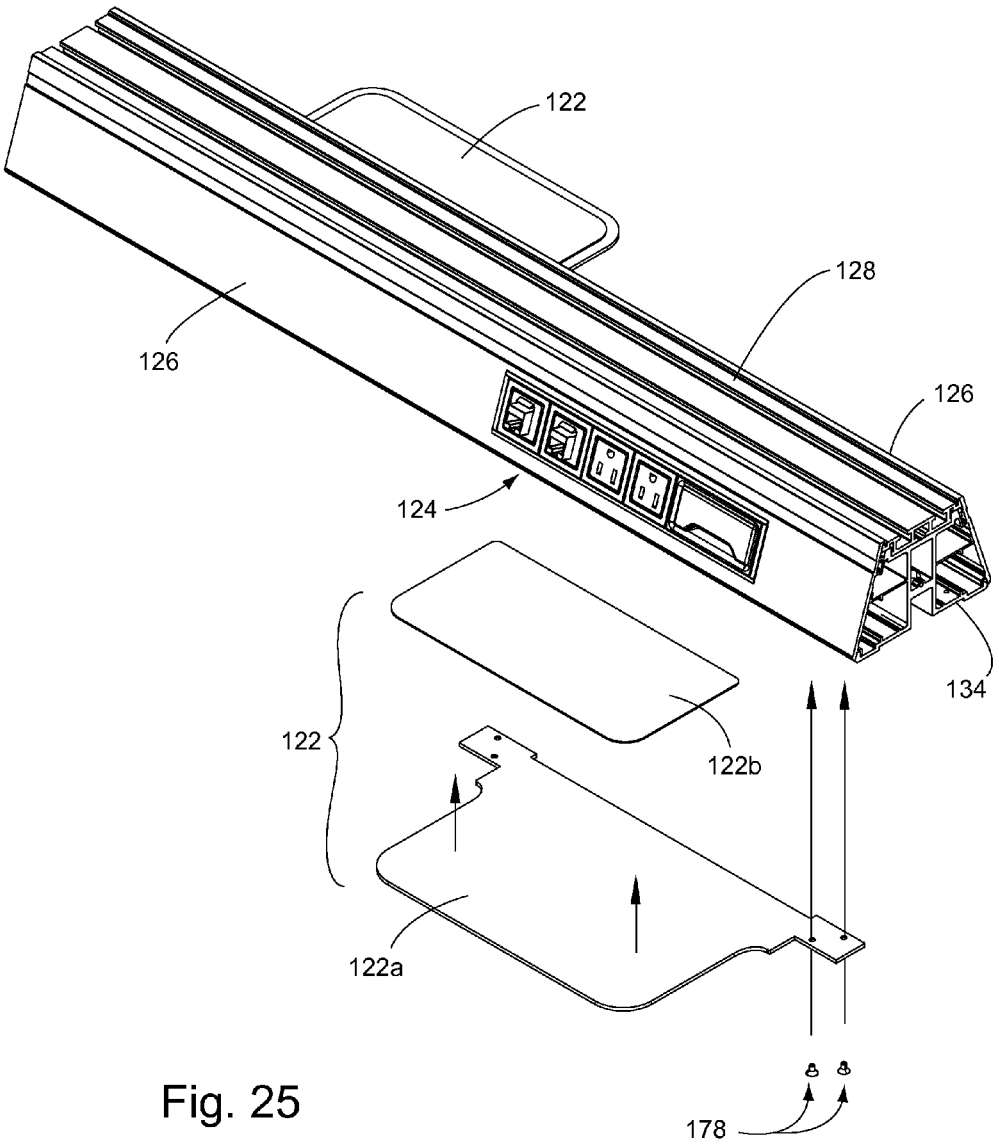
FIG. 25 is a perspective view of support pads being coupled to the support structures that already have had the top rail, side panels, and power and data units coupled thereto as in FIG. 24C.

Support pads 122 may have a substantially rigid lower portion 122*a* that couples to support structure elements 134 via threaded fasteners 178 or the like, and may have a soft and/or aesthetic upper pad portion 122*b*, such as shown in FIG. 25. For example, upper pad portion 122*b* may be made of rubber or rubber-like material, felt, cork, or the like. Lower portion 122*a* may be made from aluminum, steel (e.g. 10 ga. stamped or laser-cut steel). Because it is often desirable to have a padded support surface near electrical and/or data outlets near a work surface, and because support structure elements 134 are typically spaced apart on either side of a given power and data unit 124, support pads 122 are typically aligned with power and data units such as shown in the drawings. However, it is envisioned that support pads 122 could be positioned elsewhere along the system, and need not be limited to the locations of power and data centers 124.

Figure 25A:
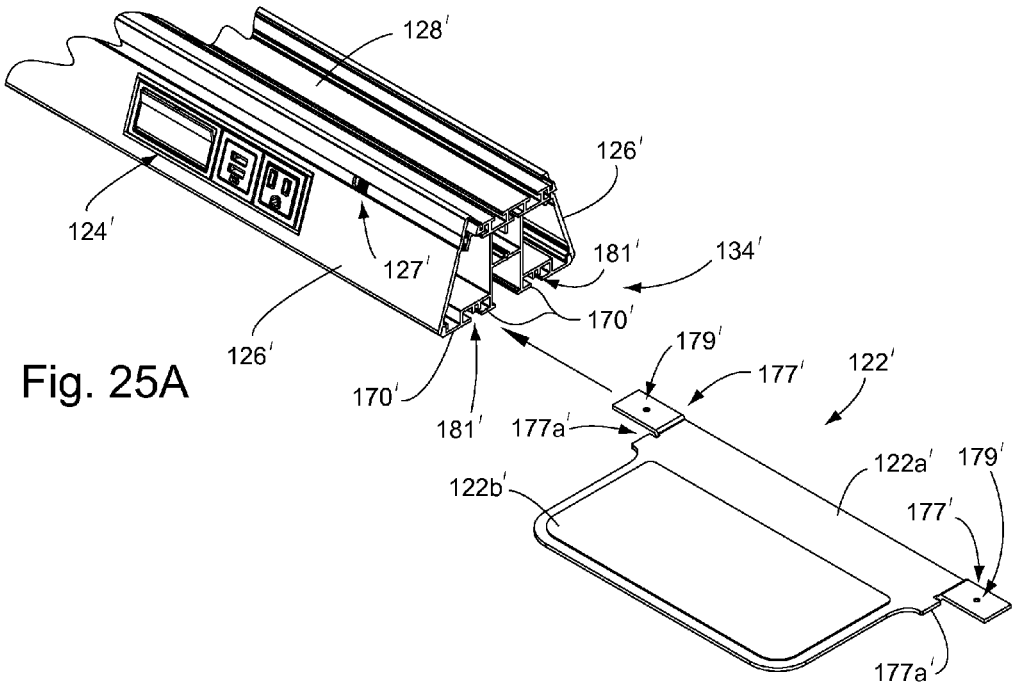
FIGS. 25A and 25B are perspective views of a different support pad being coupled to the support structures of a work surface coupling system.
Figure 25B:
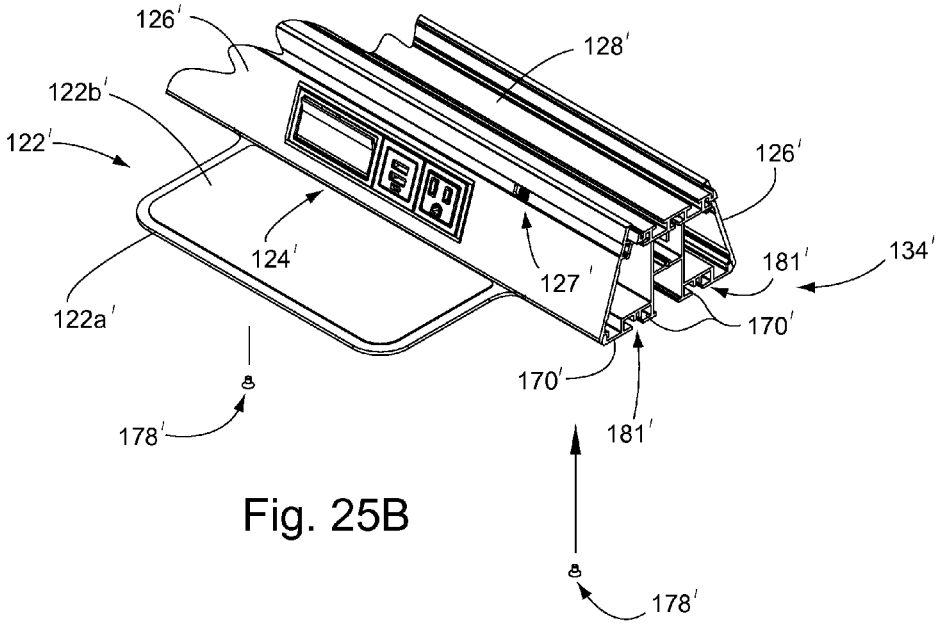

Optionally, support pads 122' may be coupled to respective pairs of support structure elements 134' via threaded fasteners 178 (FIGS. 25A and 25B). Support pads 122' are substantially similar to the support pads 122 described above, including a substantially rigid lower portion 122*a*' and a soft and/or aesthetic upper pad portion 122*b*'. In the illustrated embodiment of FIGS. 25A and 25B, the rigid lower portion 122*a*' includes a pair of elevated or raised mounting tabs 177' with respective bores 179' for receiving fasteners 178. The raised mounting tabs 177' may be slid into engagement with respective mounting slots 181' that are formed in the lower portion of support structure elements 134', so that the two mounting tabs 177' of a given support pad 122' may be effectively captured in the exposed ends of mounting slots 181' of two spaced-apart support structure elements 134' located on either side of a power and data unit 124'. At the same time, secondary tabs 177*a*' that are located just outboard of each mounting tab 177' will engage an outboard portion of horizontal bottom wall 170' of each support structure element 134'. Thus, secondary tabs 177*a*' are configured to resist upward bending moments applied to an outboard region of each support pad 122', such as due to a side loading applied to a work surface accessory attached to top rail 128', which results in an upward force applied to the underside of the outboard end of the support pad 122' by the work surface S. This upward force, acting on the outboard end portions of the support pad 122', is transferred to the lower regions of the support structure elements 134' that are located on either side of a given support pad 122', by raised mounting tabs 177' and secondary tabs 177*a*'.

Figure 30A:
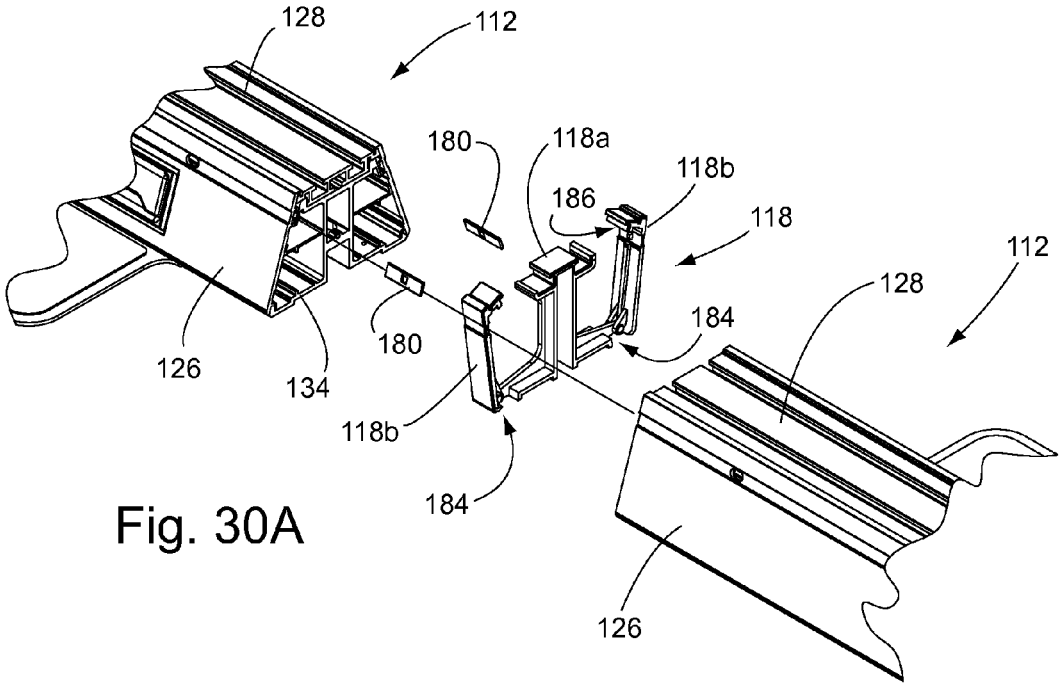
FIGS. 30A-30E are perspective views depicting five steps of coupling two adjacent coupling system subassemblies together, in end-to-end arrangement, to assemble the work surface coupling systems of FIGS. 10-12.
Figure 30B:
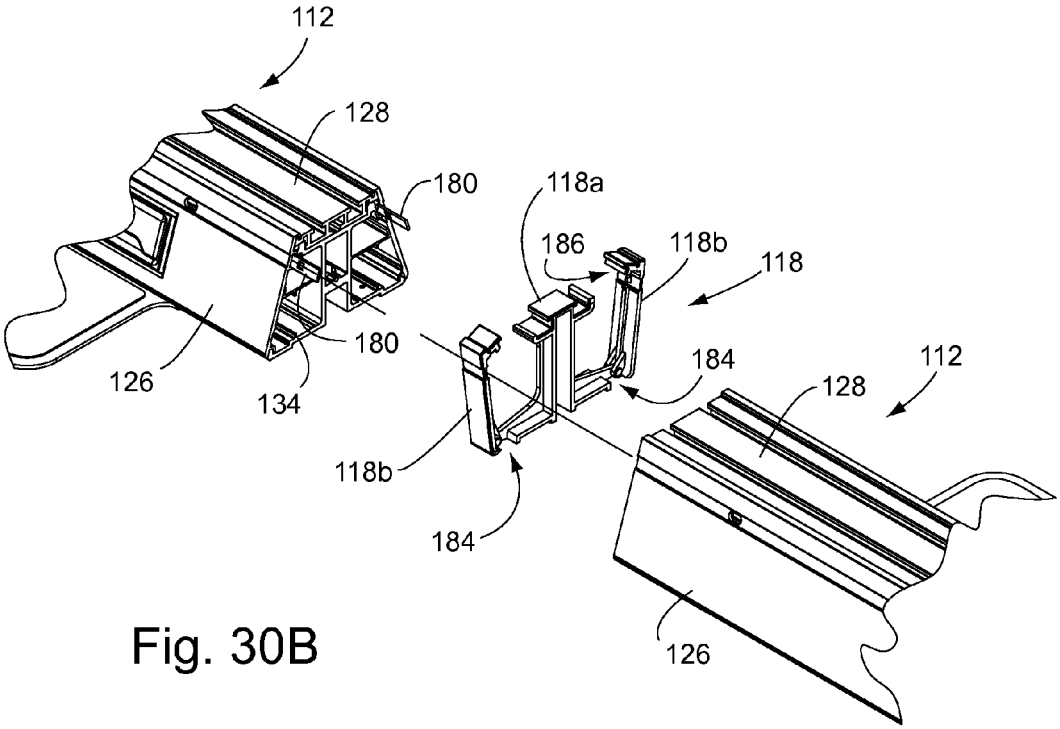
Figure 30C:
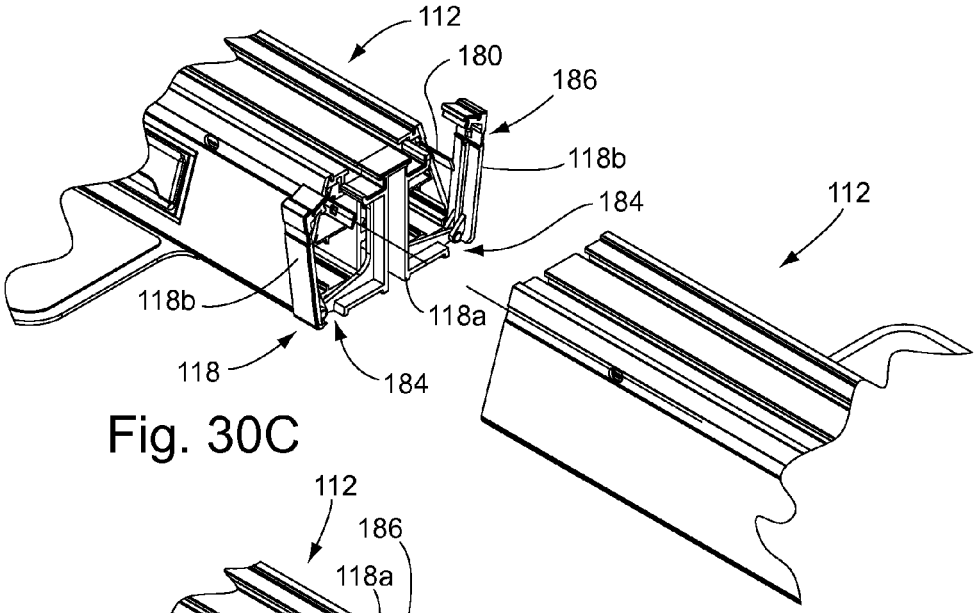
Figure 30D:
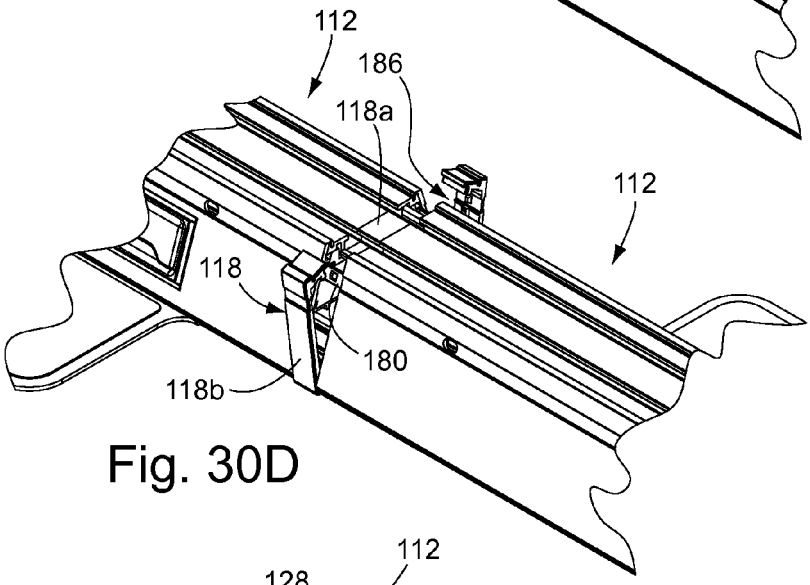

As briefly noted above, junction pieces 118 may be used to join adjacent sections 112 of coupling system 110 in end-to-end arrangement. This process is illustrated in FIGS. 30A-30E, in which tab inserts 180 are inserted into a channel 182 (FIGS. 24A-24C) that is formed between inwardly-projecting legs 166 of each side panel 126, such as shown sequentially in FIGS. 30A and 30B. Junction piece 118 may be a three-piece unit having a central portion 118*a* and a pair of outboard openable portions 118*b* that are coupled at their lower ends to central portion 118*a* via respective hinge joints 184. Junction piece 118 is engaged with an end of one section 112, such as shown in FIG. 30C, and may be at least temporarily held in place there via frictional engagement of various surfaces of the junction piece 118 with correspondingly-shaped surfaces of support structure element 134. The adjacent section 112 is then moved into position (FIG. 30D) so that tab inserts 180 are received in the corresponding channels 182 of the adjacent section's side panels 126. Once both adjacent sections 112 are together at junction piece 118, a joiner plate 188 may be coupled to the respective support structure elements 134 of the adjacent sections 112, such as via threaded fasteners that engage the horizontal bottom walls 170 of each support structure element 134, such as shown in FIGS. 15 and 17.

Figure 30E:
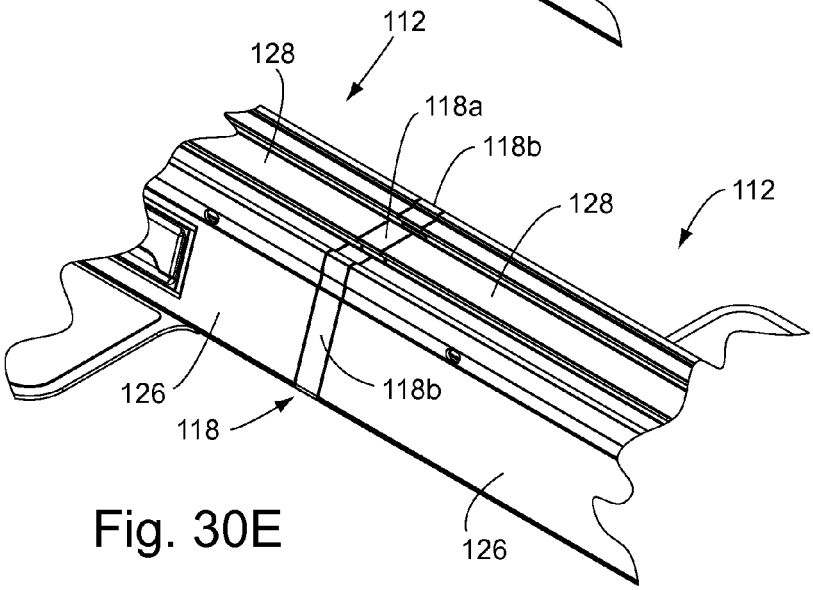

Outboard openable portions 118*b* of junction piece 118 are movable between a closed position in which the outer shape of junction piece 118 generally conforms to the outer shape of the sections 112, such as shown in FIGS. 12 and 30E, and an open position (FIGS. 30A-30D and 33) that provides access to elongate channels 173, 175, such as for routing or accessing wiring 190 (FIG. 33) that is disposed inside of coupling system 110. When openable portions 118*b* are closed, a portion of the respective tab insert 180 is received in a channel 186 (FIGS. 30A-30D) that is formed along an inner surface of each openable portion 118*b*. Each openable portion 118*b* may be releasably secured to tab insert 180 via a snap-engagement element, a magnet, a hook-and-loop fastener, or the like, or may be more securely held closed such as with a threaded fastener or other type of mechanical coupler.

Figure 28:
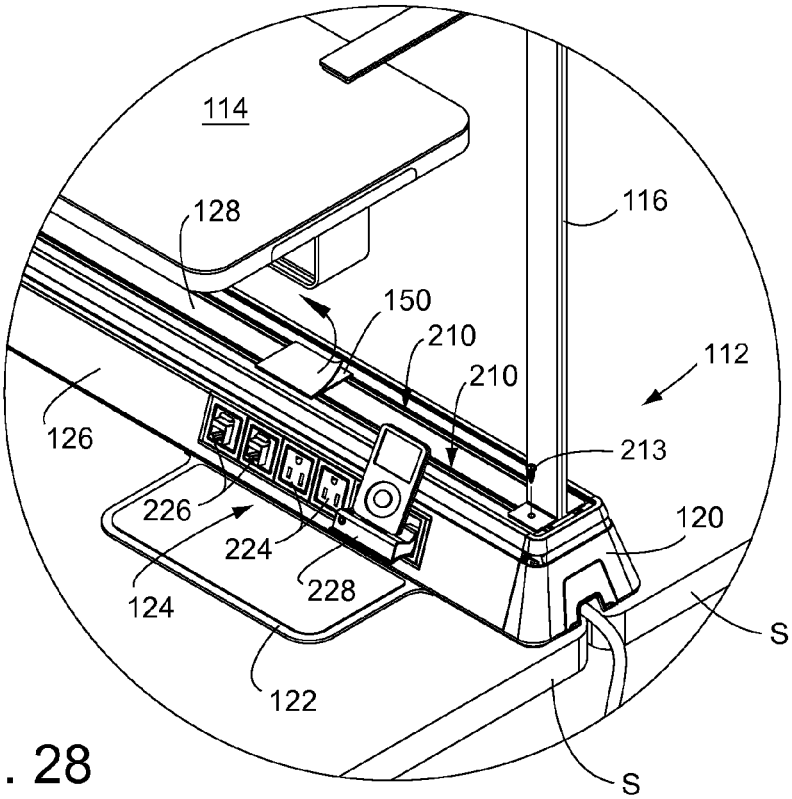
FIG. 28 is a perspective view of an optional shelf being installed along the top rail of the work surface coupling system via an adhesive pad, and a lamp accessory being installed along the top rail in a manner similar to that of the privacy panel attachment shown in FIG. 27.
Figure 31A:
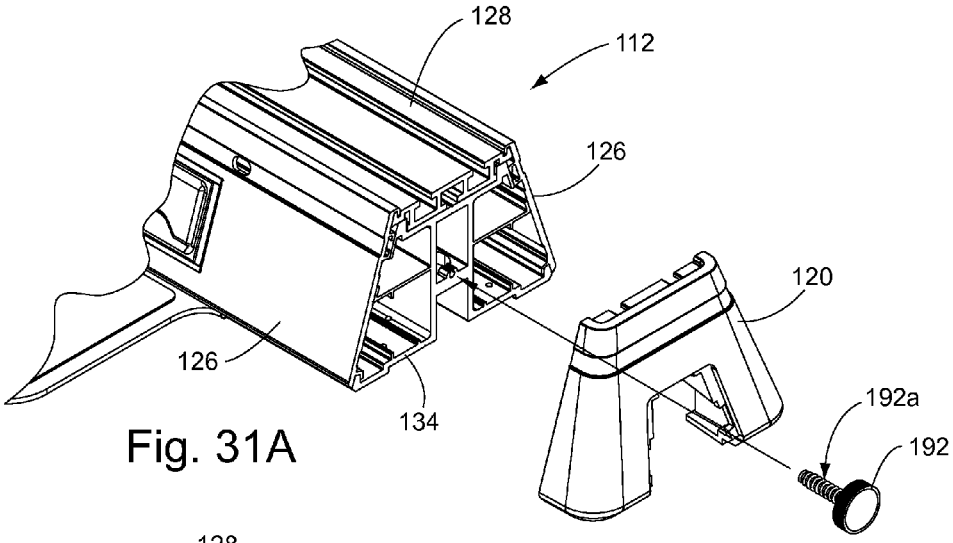
FIGS. 31A-31C are perspective views depicting three steps of coupling an end cap to an end of a coupling system subassembly like that of FIG. 25.
Figure 31B:
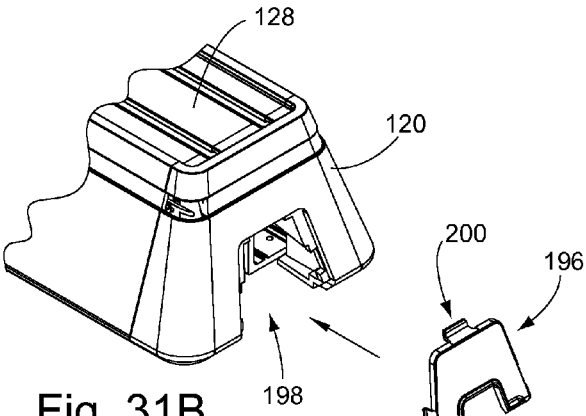
Figure 31C:
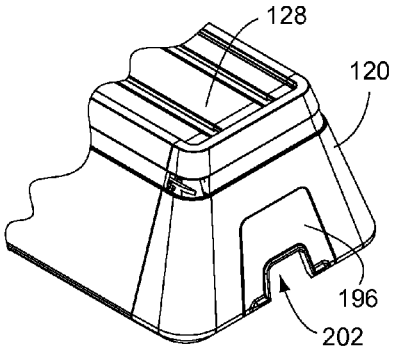
Figure 32A:
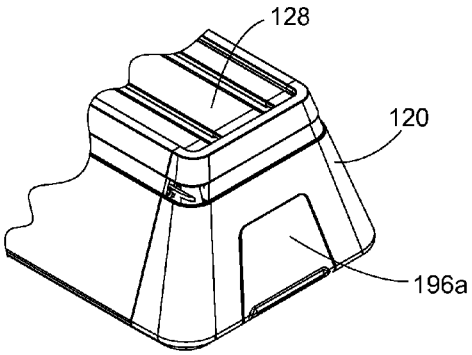
FIGS. 32A and 32B are perspective views of an end of the work surface coupling system, showing optional end cap closures.
Figure 32B:
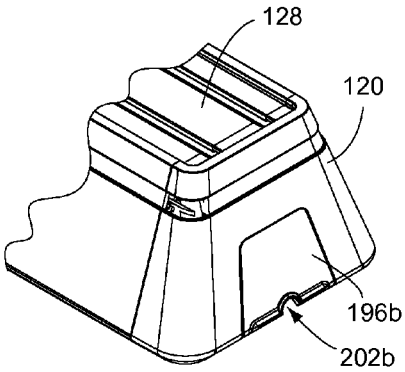

To present a finished appearance, end caps 120 are affixed or attached to the open ends of the end-most sections 112, such as in the manner shown in FIGS. 31A-31C. In the illustrated embodiment, a thumbscrew 192 is used to secure each end cap 120 to the support structure element 134 of the end-most section 112. Thumbscrew 192 includes a threaded shaft portion 192*a* that passes through an opening formed in end cap 120 and engages a screw channel 194 (FIG. 24C) that is formed along a top surface of the horizontal middle wall 142 of support structure element 134. End cap 120 may include additional projections along its inner surface, for engaging corresponding surfaces of support structure element 134, in order to further secure the end cap 120. Once thumbscrew 192 has secured end cap 120 to the end-most support structure element 134, an end cap cover 196 is snap-fit into engagement with a recess or opening 198 formed at a lower end of end cap 120, such as shown sequentially in FIGS. 31B and 31C. End cap cover 196 has a plurality of latch tabs 200 (FIG. 31B) that engage the edges defining opening 198 in a hook-like manner, and is thus removable by hand. End cap cover 196 may have its own recess or opening 202 that serves as a wire pass-through, such as shown in FIGS. 10 and 28, and may also be used for grasping and pulling end cap cover 196 away from end cap 120 with a finger or tool. Optionally, it is envisioned that an end cap cover 196*a* may have no opening at all (FIG. 32A), or an end cap cover 196*b* may have only a small opening 202*b* that provides limited space for a wiring pass-through.

In the illustrated embodiment, and with reference to FIGS. 15 and 17, the end-most support structure element 134 is prevented from pulling away from top rail 128 and side panels 126 by way of its coupling to rigid lower portion 122*a* of support pad 122, which in turn is coupled to another support structure element 134 on the other side of power and data unit 124, which other support structure element 134 is coupled to an adjacent support structure element 134 of an adjacent section 112 via a joiner plate 188, and so on until the opposite end of the coupling system 110 is reached and all parts are secured together. It will be appreciated that when top rail 128 is coupled to support structure elements 134 using the methods of FIG. 21B or 21C, for example, the finished coupling system 110 has no exposed fasteners that would be visible from above the work surfaces S.

Figure 26:
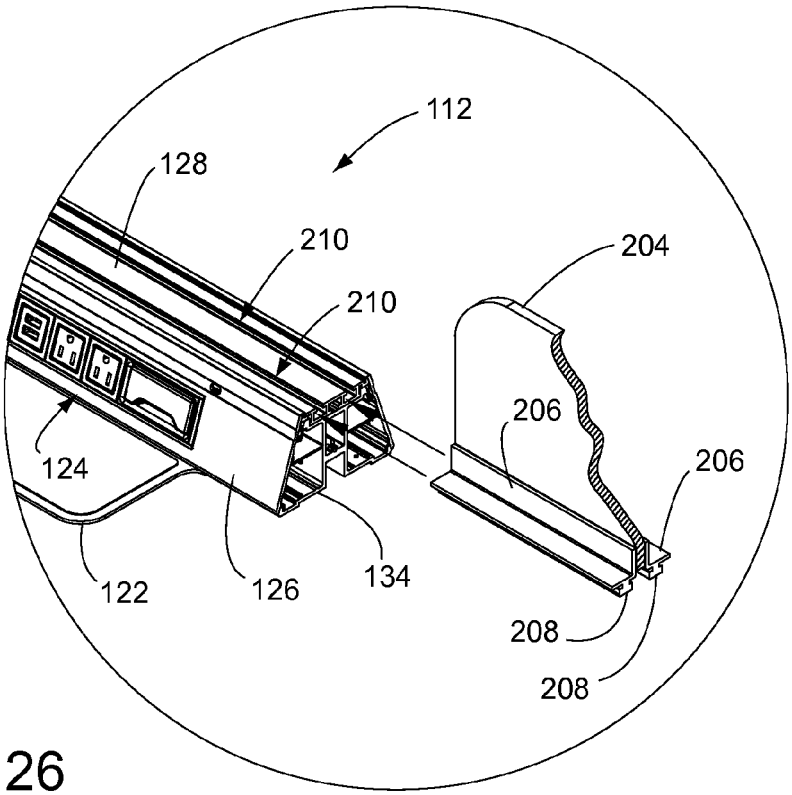
FIG. 26 is a perspective view of an optional privacy panel accessory being slidably engaged with top rail of the partial assembly of the work surface coupling system shown in FIG. 25.
Figure 27:
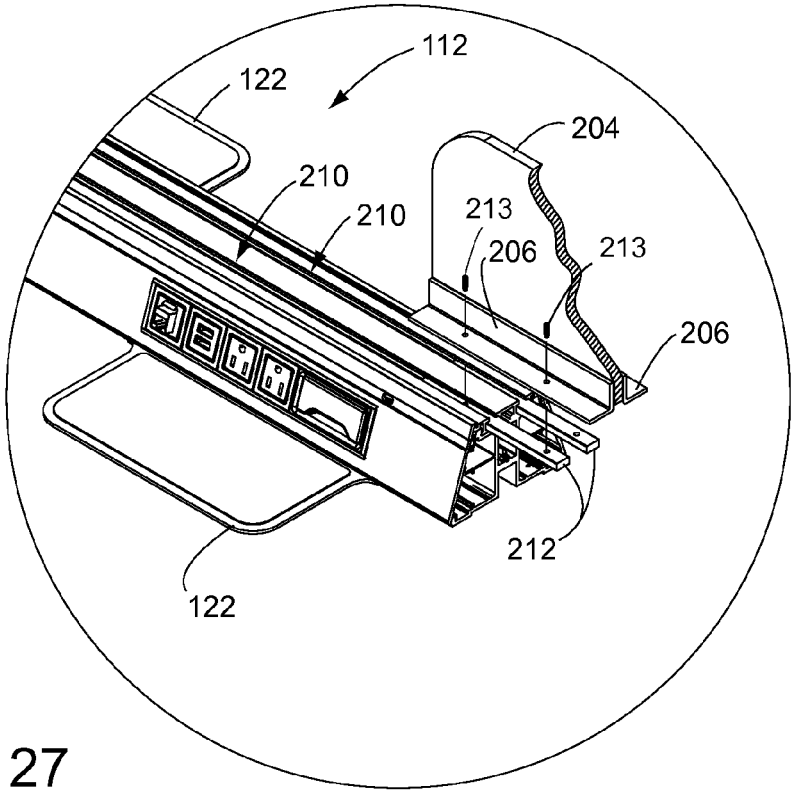
FIG. 27 is a perspective view of the privacy panel accessory of FIG. 26, in which alternate mounting hardware is used to secure the panel accessory to the top rail.

Referring now to FIGS. 26 and 27, a privacy panel or divider wall 204 may be slidingly engaged and secured along top rail 128 via a pair of L-shaped mounting flanges 206. In the embodiment of FIG. 26, elongate inverted T-shaped rails 208 are formed along (or coupled to) the undersides of mounting flanges 206, and are sized and shaped to slidingly engage an accessory coupling surface including outboard slots 210 formed in top rail 128, such as shown in FIGS. 24A-24C. Optionally, it is envisioned that inverted T-shaped pins or studs could be used in place of rails. In the embodiment of FIG. 27, two inserts 212 with threaded bores are inserted into outboard slots 210 (which are also generally shaped as inverted T's), and are threadedly engaged by screws 213 that are driven through mounting flanges 206. In FIG. 28, a lamp 116 is secured in a similar manner, such as by inserting female fasteners 152 into slots 210 and securing with screws or bolts 213. It will be appreciated that substantially any type of top-mounted accessory may be coupled to top rail 128 in one of these manners, or in a similar manner. It will be appreciated that access to outboard slots 210, for installing accessories in the manners shown in FIGS. 26 and 27, is available prior to installation of an end cap 120 (or by first removing an end cap). Optionally, such as when a work surface accessory (such as lamp 116) requires a supply of electrical current, electrical wiring may be routed through slots 210 and/or through a hole or opening that is formed or established through top rail 128 or another surface, so that the wiring may continue to pass through one of elongate channels 173, 175.

Figure 29:
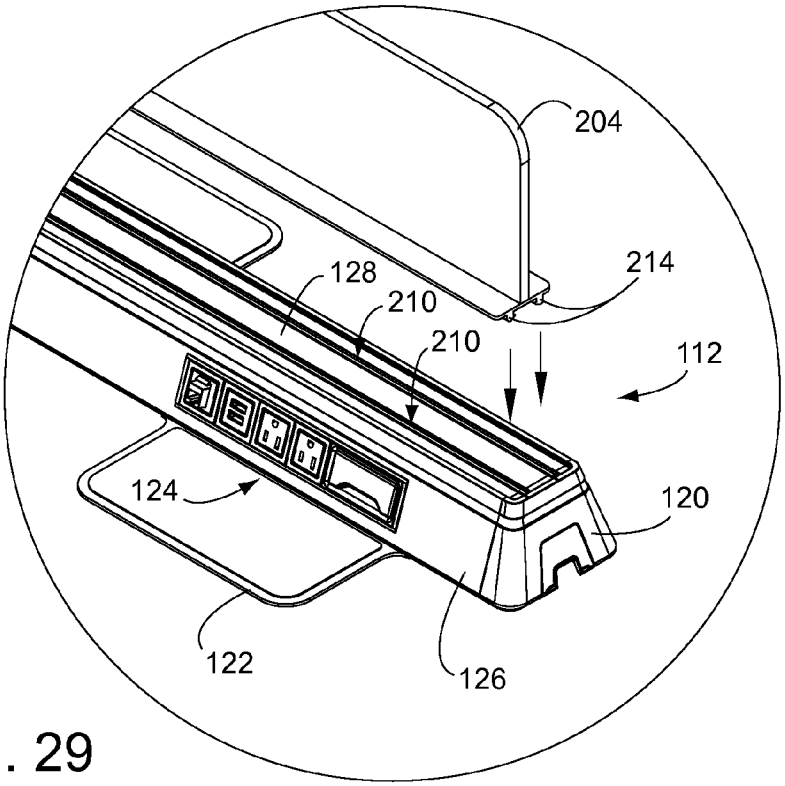
FIG. 29 is a perspective view of another optional privacy panel being installed along the top rail of the work surface coupling system.

It is further envisioned that accessories may be installed from above, such as by using an oblong attachment member that can be inserted into outboard slots 210 from above in one orientation, and which can be secured in the slots 210 by rotating to a different orientation, such as rotating by about 90 degrees. Accessories may also be screwed directly to top rail 128, such as with self-tapping screws, or may be secured using adhesive pads 150 such as shown in FIG. 28. Optionally, accessories may have snap-fit engaging members 214 that are sized and shaped (with hook portions) to engage respective slots 210 from above, such as shown in FIG. 29. Optionally, a top cap member may be positioned between work surface accessories that are disposed along the top rail, and/or between a work surface accessory and one of the end caps 120, with the top cap member engaging the top rail in a similar manner as the work surface accessories describe above. For example, a top cap member may have a generally planar or convex or crowned top surface, and a pair of elongate inverted T-shaped rails like the rails 208 of mounting flanges 206, for engaging the respective slots 210 in top rail 128. The top cap member may be an extruded section that is readily cut to a desired length, and it is envisioned that multiple top cap members may be installed along a given top rail between accessories, in order to present a clean, finished appearance to the coupling system 110.

Figure 34A:
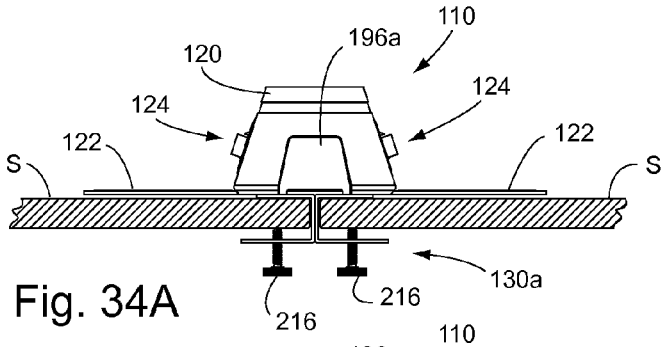
FIGS. 34A-34E are end elevations of the work surface coupling system and work surfaces similar to those of FIG. 11, but showing different optional joining members.
Figure 34B:
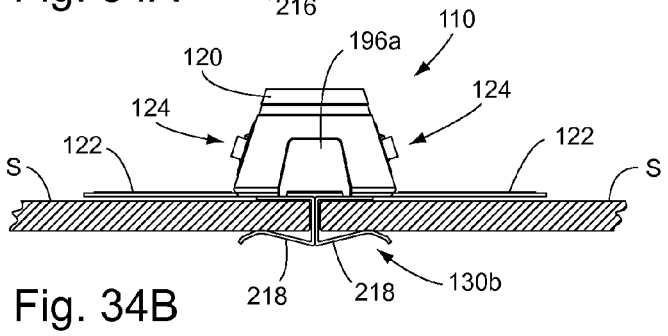
Figure 34C:
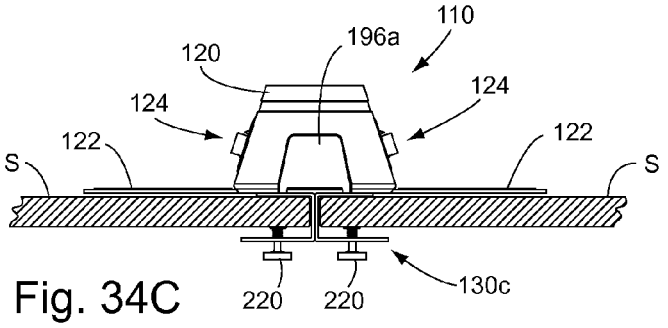
Figure 34D:
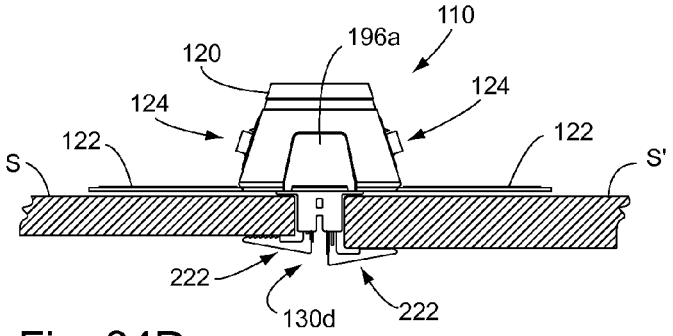
Figure 34E:
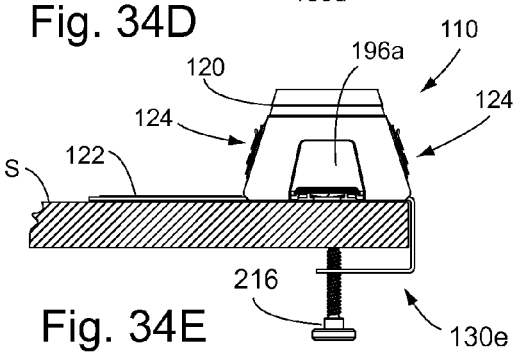

As noted above, various forms of work surface couplers or clamping portions 130*a-e* are envisioned for securing coupling system 110 between two adjacent work surfaces S, and for securing the work surfaces S together, such as shown in FIGS. 34A-34E. These include moveable lower coupler portions such as, for example, a screw-type clamping portion 130*a* (FIG. 34A) in which thumbscrews 216 directly impinge on an underside of each work surface S, a resilient-clip clamping portion 130*b* (FIG. 34B) in which the edge portions of each surface S are received above a respective resilient elongate arm or clip 218, another screw-type clamping portion 130*c* (FIG. 34C) in which thumbscrews 220 have padded tips and/or may be spring-biased (rather than threaded) into engagement with the undersides of the work surfaces S, and height-adjustable ratcheting clamp portions 222 (FIG. 34D) that are adjustable to accommodate work surfaces of different thickness S, S' and/or slightly misaligned surfaces. Referring to FIG. 34E, a single-surface clamping portion 130*e* is configured to engage an outer perimeter edge portion of only one work surface S, so that the work surface coupling system 110 is positioned fully over the work surface. Single-surface clamping portion 130*e* includes one or more thumbscrews 216 for securing it to the work surface S. In the illustrated embodiments of FIGS. 34A-34E, each of the work surface couplers defines one or two generally C-shaped channels for receiving respective outer perimeter edge portions of one or two work surfaces S.

In the embodiments of FIGS. 34A-34D, support pads 122 are illustrated as being spaced slightly above the respective work surfaces S, but it is envisioned that the support pads could also be configured to lie directly atop work surfaces S, such as shown in FIG. 34E. Support pads 122 may be used for supporting hand held electronic devices (FIG. 38), and may be energized for wireless charging such devices, such as in the manner described in commonly-owned U.S. patent application Ser. No. 13/385,008, filed Jan. 27, 2012, and corresponding to U.S. Publication No. 2012/0200989. Support pads 122 may also be configured with coasters for beverage containers (FIG. 39), or for note pads (FIG. 40) or the like.

Each work surface coupler or clamping portion 130*a-e* is secured to a respective support structure element 134', such as in one of the manners shown in FIGS. 35A-35C and 36A-36C. For example, and with reference to FIGS. 35A-35C, a mechanical fastener such as a thumbscrew or hand-tightenable shoulder bolt 240 is passed through an opening 242 formed in a surface 244 that may be associated with (or a part of) substantially any given work surface coupler. Bolt 240 is then threadedly received in an opening 246 formed in a threaded insert 248, which is received in central lower channel 183' of support structure element 134'. Threaded insert 248 is supported on inwardly-directed elongate shoulders or ledges 185' at the bottom of central lower channel 183' (FIG. 35A). Further tightening of bolt 240 will secure the surface 244 against the horizontal bottom wall 170' of support structure element 134', or against a lower surface of work surface S. In the illustrated embodiment, threaded insert 248 is generally in the shape of a parallelogram, such as shown in FIG. 35B, but it will be appreciated that other shapes may be used, such as square or rectangular.

Figure 36A:
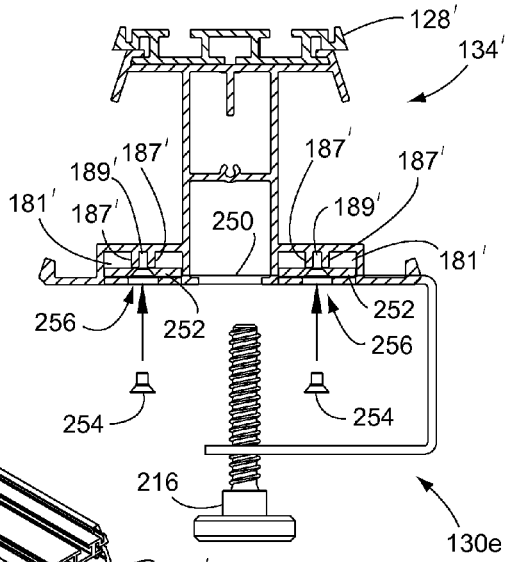
FIG. 36A is a sectional end elevation of a mounting arrangement for securing a work surface coupler to a support structure element.
Figure 36B:
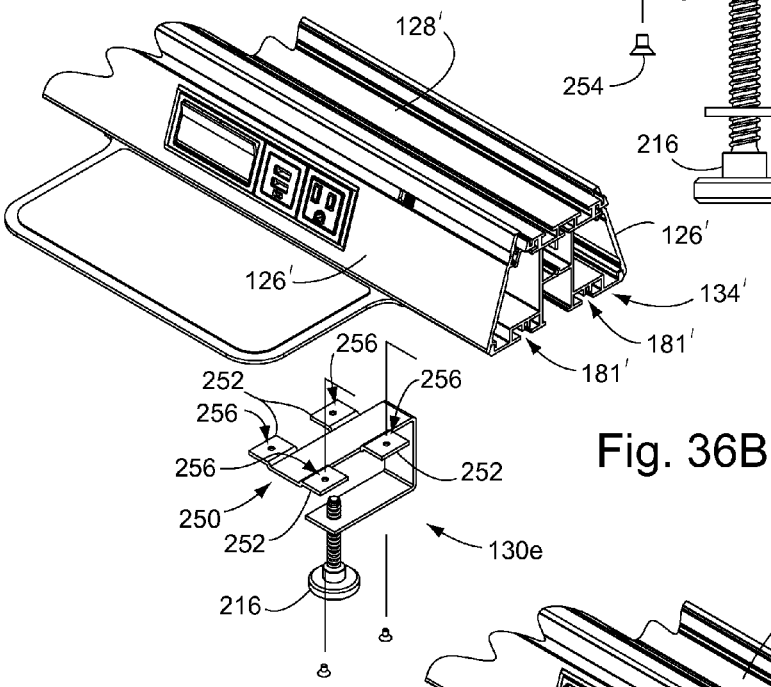
FIGS. 36B and 36C are perspective views of an end portion of a work surface coupling system, showing two steps of securing the work surface coupler of FIG. 36A.
Figure 36C:
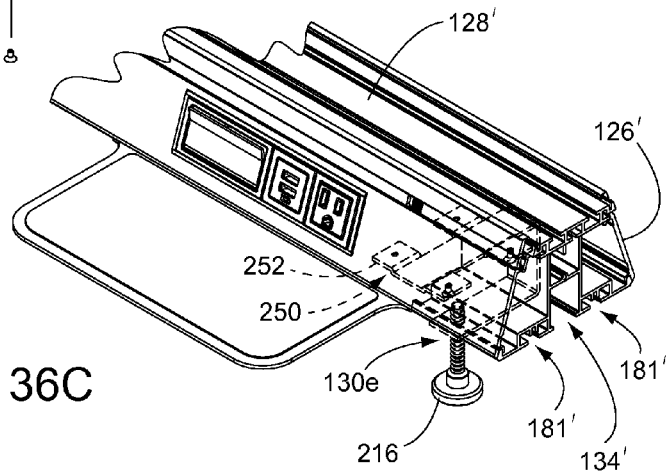
Figure 37A:
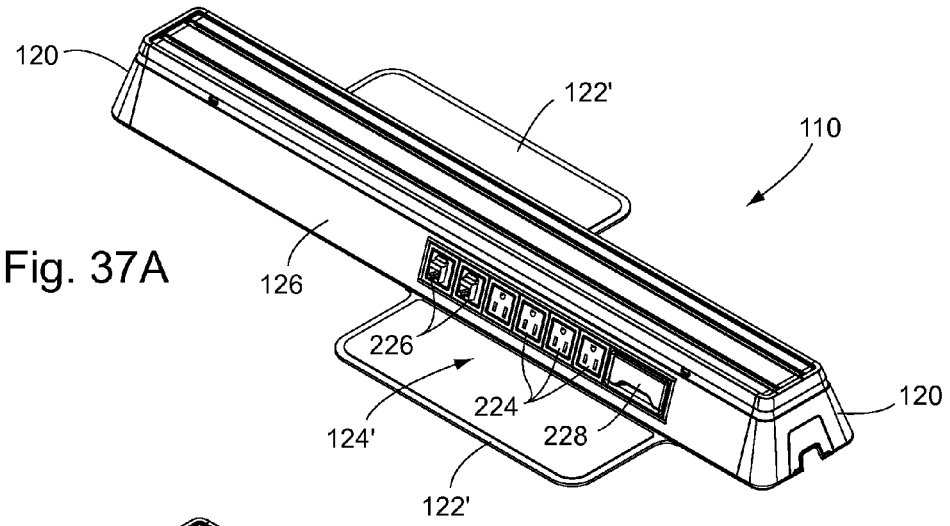
FIG. 37A is a perspective view of a single-section work surface coupling system with an extra-capacity power and data unit with lengthened support pad, and which is otherwise substantially the same as the systems of FIGS. 11 and 12.
Figure 37B:
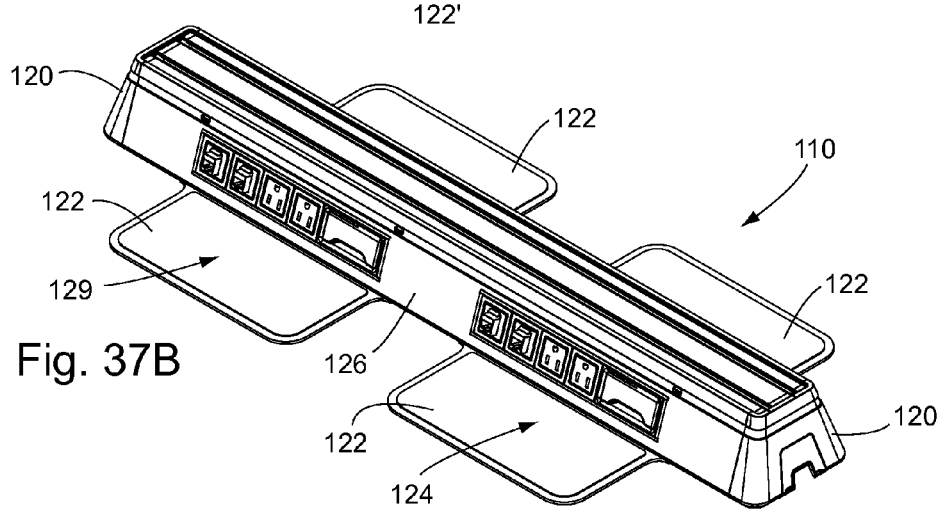
FIG. 37B is a perspective view of another single-section work surface coupling system having four support pads and four power and data units, and which is otherwise substantially the same as the system of FIG. 37A.
Figure 37C:
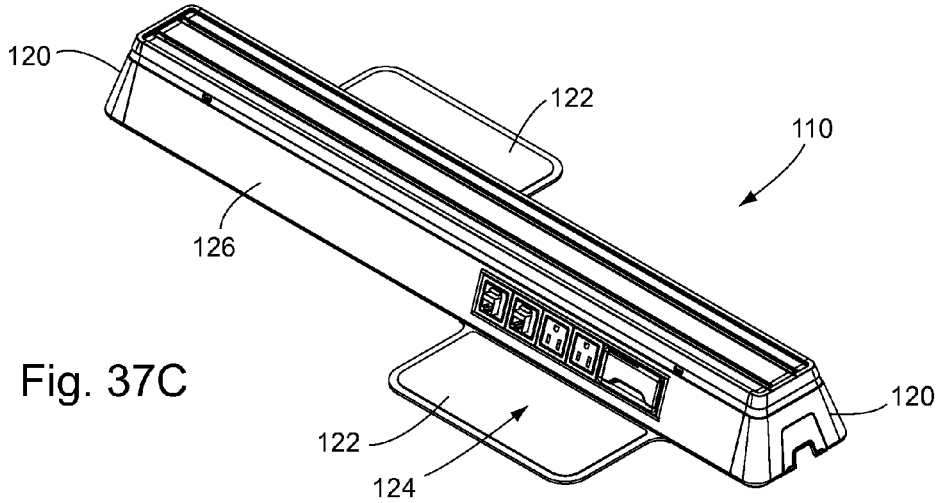
FIG. 37C is a perspective view of a single-section work surface coupling system like that of FIG. 37A, but with a smaller-capacity power and data unit.
Figure 38:
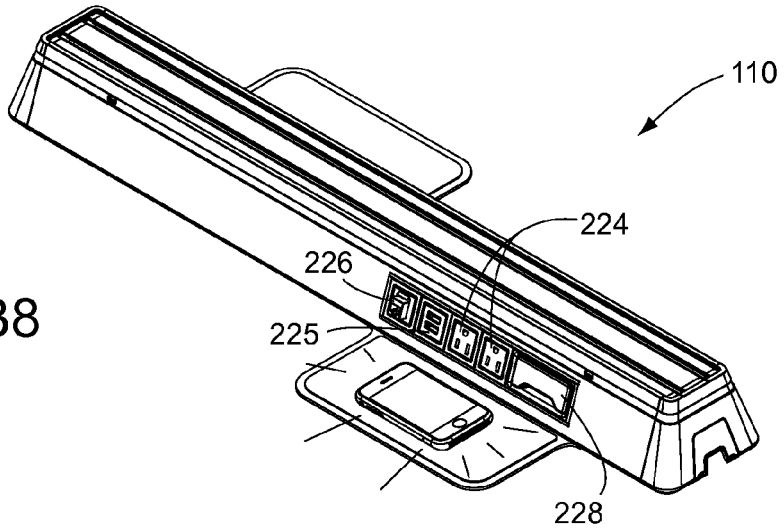
FIG. 38 is another perspective view of the coupling system of FIG. 37C, shown with a hand-held mobile computer on a support pad, with optional wireless charging capability.
Figure 39:
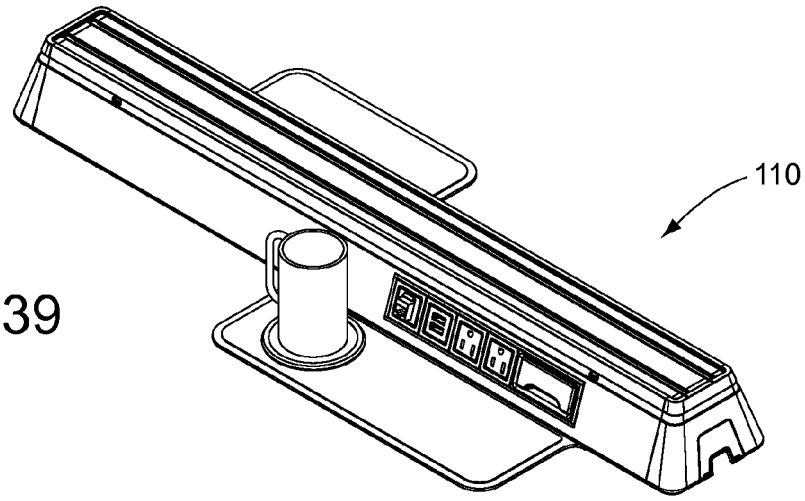
FIG. 39 is a another perspective view of the coupling system of FIG. 37C, shown with a beverage mug on an optional mug support and/or heating section on the support pad.
Figure 40:
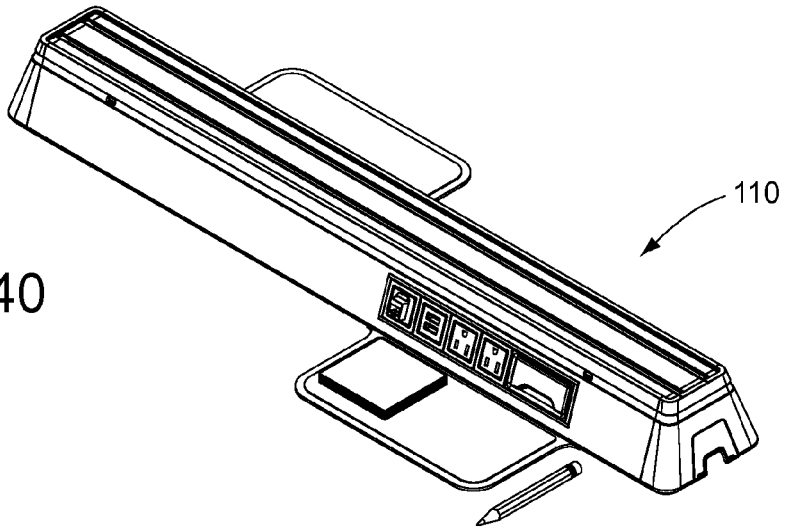
FIG. 40 is another perspective view of the coupling system of FIG. 37C, shown with a note pad on the support pad.

In the alternative arrangement of FIGS. 36A-36C, single-surface clamping portion 130*e* is shown with an upper surface portion 250 that includes a two pair of elevated or raised mounting tabs 252, with two of the tabs 252 in spaced arrangement on either side of the upper surface portion 250. The mounting tabs 252 are arranged to be received in respective ones of the mounting slots 181' that are formed in the lower end of support structure element 134', such as shown in FIGS. 36A and 36B. Once the tabs 252 are seated in the mounting slots 181', threaded screws 254 may be inserted through openings 256 formed in tabs 252, and engaged in the screw-receiving channel 187' that is formed between the pair of ribs 189' extending longitudinally along an upper region of mounting slots 181', such as shown in FIG. 36A. Screws 254 may have self-tapping threads so that the screws may be readily secured to different locations along the ribs 189', which may be made of a relatively soft material such as extruded aluminum.

Optionally, the other set of tabs 252 (i.e., those not engaged in slots 181' as shown in FIG. 36C) could be mounted in the mounting slots of another support structure element, but it is generally sufficient that only one set of the tabs 252 is secured in the manner described above, while the other set of tabs remain un-engaged, such as shown in FIG. 36C. However, the inclusion of tabs 252 on both sides of the upper surface portion 250 allows a given work surface coupler to be oriented differently, and/or to be secured on either side to a support structure element 134'. It will be appreciated that the mounting arrangement of FIGS. 36A-36C may be used for securing substantially any work surface coupler to a support structure element or other lower portion of the coupling system.

In its various forms or embodiments, work surface coupling system 110 may include extra-capacity power and data units 124' with extra-length support pads 122' (FIG. 37A), or may include two or more power and data units 124 on each side panel 126 of each section 112 (FIG. 37B), or may include no power and data units at all. It will also be appreciated that power and data units 124, where included, represent substantially any center or unit that provides at least one high voltage power receptacle 224 (e.g. 110V or 220V AC), and/or at least one low voltage power receptacle 225 (FIG. 38) (e.g. 2V to 20V DC) power receptacle, at least one data and/or voice communications receptacle 226, a charging or docking or connectivity station 228, or the like, such as shown in the various figures and indicated with reference numerals in FIGS. 28, 37A, and 38. Various such receptacles are described, for example, in the commonly-owned U.S. patent applications corresponding to U.S. Publication Nos. 2011/0095724 and 2011/0043984, which are hereby incorporated herein by reference in their entireties. Optionally, it is envisioned that the desired receptacles could be installed directly in appropriately sized and shaped openings formed in side panels 126 (similar to opening 154, but smaller), so that a multi-receptacle unit 124 is not required to provide power and/or data capability at the coupling system.

It will also be appreciated that a large variety of optional accessories may be fitted to (or included in) work surface coupling system 110, such as shown in FIG. 41, in which tall privacy panels 204' are installed along the full length of the system, and with optional shelving/storage units 230 coupled along one side thereof. Another system 110 may be fitted with shelving and storage units 232 in spaced arrangement (FIG. 42), with a central open space 234 defined between them, where an open section of top rail 128 is available for coupling lamps 116, shelves 114, or other optional accessories. Power may be routed to lamps 116 or other power-consuming accessories via openings formed in top rail 128, similar to bores 149 shown in FIGS. 21A and 21B, which can be particularly straightforward when only low-voltage power is needed. However, it is also envisioned that wireless power and/or charging may be provided in the region above top rail 128, such as with inductive coils or the like.

Accordingly, the work surface coupling system of the present invention provides a substantially integrated or self-contained unit for securely join two or more work surfaces together, while also providing power and/or data outlets near one or more (or all) of the work surfaces, hidden storage for wiring associated with the outlets, and the option of mounting additional work surface accessories, if desired.

The embodiments of the invention in which an exclusive property or privilege is claimed are defined as follows:

1. A work surface coupling system adapted to provide power or data access, said system comprising:

an elongate housing configured to be positioned along a work surface, said elongate housing comprising upper and lower portions, and left and right side portions;

wherein at least one of said left and right side portions comprises a removable side panel;

at least one power or data outlet supported at said removable side panel; and a work surface coupler at or below said lower portion of said elongate housing, said work surface coupler configured for coupling to an outer perimeter edge portion of the work surface;

wherein said work surface coupler is configured to releasably engage respective outer perimeter edge portions of two adjacent work surfaces, whereby said adjacent work surfaces are coupled together by said work surface coupler.

2. The work surface coupling system of claim 1, wherein said elongate housing defines an internal passageway configured to receive wiring associated with said at least one power or data outlet.

3. The work surface coupling system of claim 1, wherein said upper portion of said elongate housing comprises an accessory coupling surface that is configured to be engaged by a work surface accessory.

4. A work surface coupling system adapted to provide power or data access, said system comprising:

an elongate housing configured to be positioned along a work surface, said elongate housing comprising upper and lower portions, and left and right side portions, wherein at least one of said left and right side portions comprises a removable side panel;

at least one power or data outlet supported at said removable side panel;

a work surface coupler at or below said lower portion of said elongate housing, said work surface coupler configured for coupling to an outer perimeter edge portion of the work surface;

at least one support structure element configured to be positioned above the work surface, said support structure element having an upper portion, a lower portion, a left side portion, and a right side portion, wherein said lower portion of said support structure element forms said lower portion of said elongate housing;

an internal passageway defined by said support structure element and configured to receive wiring associated with said at least one power or data outlet;

an elongate rail member at said upper portion of said support structure element and forming said upper portion of said elongate housing; and a pair of said removable side panels coupled to respective ones of said left and right side portions of said support structure, said removable side panels forming said left and right side portions of said elongate housing.

5. The work surface coupling system of claim 4, wherein said work surface coupler is configured to releasably engage respective outer perimeter edge portions of two adjacent work surfaces, whereby said adjacent work surfaces are coupled together by said work surface coupler.

6. The work surface coupling system of claim 4, wherein each of said support structure element, said elongate rail member, and said left and right side panels comprises an extruded section that is configured to be cut to a desired length.

7. A work surface coupling system adapted to provide power or data access, said system comprising:

an elongate housing configured to be positioned along a work surface, said elongate housing comprising upper and lower portions, and left and right side portions, wherein at least one of said left and right side portions comprises a removable side panel;

at least one power or data outlet supported at said removable side panel;

a work surface coupler at or below said lower portion of said elongate housing, said work surface coupler configured for coupling to an outer perimeter edge portion of the work surface; and a support pad coupled to said elongate housing and extending laterally outwardly beyond one of said left and right side portions of said elongate housing, wherein said support pad is configured to engage an upper surface of the work surface.

8. A work surface coupling system adapted to provide power or data access, said system comprising:

an elongate housing configured to be positioned along a work surface, said elongate housing comprising upper and lower portions, and left and right side portions, wherein at least one of said left and right side portions comprises a removable side panel;

at least one power or data outlet supported at said removable side panel;

a work surface coupler at or below said lower portion of said elongate housing, said work surface coupler configured for coupling to an outer perimeter edge portion of the work surface; and a junction piece, wherein at least two of said elongate housings are coupled together in end-to-end arrangement by said junction piece disposed between said elongate housings.

9. The work surface coupling system of claim 8, wherein said junction piece comprises a central portion and a pair of outboard portions, wherein at least one of said outboard portions is pivotably coupled to said central portion and is movable to an open position that provides access to said internal passageway.

10. A work surface coupling system adapted to provide power or data access, said system comprising:

an elongate housing configured to be positioned along a work surface, said elongate housing comprising upper and lower portions, and left and right side portions;

an accessory coupling surface at said upper portion of said housing, wherein said accessory coupling surface is configured to be engaged by a work surface accessory;

at least one power or data outlet supported at said elongate housing; and a work surface coupler at or below said lower portion of said elongate housing, said work surface coupler configured for coupling to an outer perimeter edge portion of the work surface;

wherein said accessory coupling surface defines at least one elongate slot in the shape of an inverted T, and wherein said at least one elongate slot is configured to receive an insert or a rail associated with the work surface accessory.

11. The work surface coupling system of claim 10, further comprising a support pad coupled to said lower portion of said elongate housing and extending laterally outwardly beyond one of said left and right side portions, wherein said support pad is configured to engage an upper surface of one of the work surface.

12. A work surface coupling system adapted to provide power or data access, said system comprising:

an elongate housing configured to be positioned along a work surface, said elongate housing comprising upper and lower portions, and left and right side portions;

a work surface accessory comprising at least one chosen from (i) a shelf, (ii) a privacy screen, (iii) a storage unit, and (iv) a lighted accessory;

an accessory coupling surface at said upper portion of said housing, wherein said accessory coupling surface is configured to be engaged by said work surface accessory;

at least one power or data outlet supported at said elongate housing;

a work surface coupler at or below said lower portion of said elongate housing, said work surface coupler configured for coupling to an outer perimeter edge portion of the work surface.

13. The work surface coupling system of claim 12, wherein said accessory coupling surface defines at least one elongate slot in the shape of an inverted T, and wherein said at least one elongate slot is configured to receive an insert or a rail associated with the work surface accessory.

14. A work surface coupling system adapted to provide power or data access, said system comprising:

at least two support structure elements in spaced arrangement, said support structure elements having upper and lower portions, left and right side portions, and each of said support structure elements defining an internal passageway;

left and right side panels spanning between said support structure elements and coupled to said left and right side portions of said support structure elements, wherein at least one of said left and right side panels is configured to support at least one power or data outlet;

a work surface coupler at said lower portion of said support structure, said work surface coupler configured for coupling first and second work surfaces together; and wherein said internal passageway of said support structure element is configured to receive electrical wiring associated with the at least one power or data outlet.

15. The work surface coupling system of claim 14, further comprising a support pad coupled to said support structure element and extending laterally outwardly beyond one of said left and right side panels, wherein said support pad is configured to engage an upper surface of one of the first and second work surfaces.

16. The work surface coupling system of claim 14, further comprising an elongate rail member at said upper portion of said support structure, wherein said elongate rail member comprises an accessory coupling surface that is configured to be engaged by a work surface accessory.

17. The work surface coupling system of claim 16, further in combination with the work surface accessory, said work surface accessory comprising at least one chosen from (i) a shelf, (ii) a privacy screen, (iii) a storage unit, and (iv) a lighted accessory.

18. The work surface coupling system of claim 14, further comprising:

an elongate rail member, wherein said elongate rail member and said left and right side panels span between said support structure elements;

at least one power or data outlet mounted at an opening formed in each of said left and right side panels;

wherein said elongate rail member, said left and right side panels, and said support structure elements cooperate to define a housing having opposite end portions;

an end cap mounted at each opposite end portion of said housing; and wherein said support structure elements, said left and right side panels, and said end caps are configured to be mounted above the first and second work surfaces.

19. A work surface coupling system adapted to provide power or data access, said system comprising:

at least one support structure element having upper and lower portions, left and right side portions, and said support structure element defining an internal passageway;

left and right side panels coupled to said left and right side portions of said support structure, wherein at least one of said left and right side panels is configured to support at least one power or data outlet;

a work surface coupler at said lower portion of said support structure, said work surface coupler configured for coupling first and second work surfaces together;

wherein said work surface coupler comprises movable lower coupler portions that are configured to engage respective lower surfaces of said two adjacent work surfaces, each of said movable lower coupler portions comprising at least one chosen from (i) a threaded fastener, (ii) a screw clamp, (iii) a ratchet clamp, and (iv) a resilient clip; and wherein said internal passageway of said support structure element is configured to receive electrical wiring associated with the at least one power or data outlet.

20. The work surface coupling system of claim 19, comprising at least two of said support structure elements in spaced arrangement, with said left and right side panels spanning between said support structure elements.

* * * * *